US005757225A

United States Patent [19]

Tobita

[11] Patent Number: 5,757,225

[45] Date of Patent: May 26, 1998

[54] VOLTAGE GENERATION CIRCUIT THAT CAN STABLY GENERATE INTERMEDIATE POTENTIAL INDEPENDENT OF THRESHOLD VOLTAGE

[75] Inventor: Youichi Tobita, Hyogo, Japan

[73] Assignee: Mitsubishi Denki Kabushiki Kaisha, Tokyo, Japan

[21] Appl. No.: 673,182

[22] Filed: Jun. 27, 1996

[30] Foreign Application Priority Data

Sep. 4, 1995 [JP] Japan ..... 7-226452

[51] Int. Cl.[6] ..... G05F 3/16; G05F 3/20

[52] U.S. Cl. ..... 327/539; 327/530; 327/540; 327/541; 327/535; 323/313; 365/226

[58] Field of Search ..... 327/333, 530, 327/434, 437, 534, 535, 540, 543, 544, 545, 546; 326/60, 62, 63, 80, 81; 365/226; 323/313

[56] References Cited

U.S. PATENT DOCUMENTS 4,670,706 6/1987 Tobita ..... 327/576

5,369,354 11/1994 Mori ..... 323/313

FOREIGN PATENT DOCUMENTS 57-157315 9/1982 Japan .

60-103827 6/1985 Japan .

*Primary Examiner*—Timothy P. Callahan

*Assistant Examiner*—Dinh T. Le

*Attorney, Agent, or Firm*—Lowe, Price, LeBlanc & Becker

[57] ABSTRACT

A voltage generation circuit includes: a first MOS transistor connected between a first power supply node and an output node, and operating in a source follower mode; a second MOS transistor connected between the output node and a second power supply node, and operating in a source follower mode; and a voltage generation section using a voltage on a third power supply node having a level greater than two times a voltage from the output node and a voltage VBB on a fourth power supply node receiving a voltage lower than a measurement reference voltage of the voltage of the output node for generating and providing to the gates of the first and second MOS transistors first and second voltages of predetermined voltage levels. The voltage generation circuit can generate a voltage of a predetermined level stably even at power supply voltage with low power consumption.

20 Claims, 14 Drawing Sheets

$$\begin{cases} V_s = V_g - V_{TN} \\ V_d \geqq V_g - V_{TN} \end{cases}$$

$$\begin{cases} V_s = V_g - V_{TP} \\ \quad = V_g + |V_{TP}| \\ V_d \geqq V_g - V_{TP} \end{cases}$$

VOLTAGE GENERATION CIRCUIT THAT CAN STABLY GENERATE INTERMEDIATE POTENTIAL INDEPENDENT OF THRESHOLD VOLTAGE

BACKGROUND OF THE INVENTION

1. Field of the Invention

The present invention relates to a circuit for generating a voltage of a predetermined level, and particularly to an internal voltage generation circuit provided in an integrated semiconductor device including an MOS transistor (insulated gate type field effect transistor) as a component. More particularly, the present invention relates to a circuit for generating an intermediate voltage of a level approximately half the operating power supply voltage in a dynamic semiconductor memory device (DRAM).

2. Description of the Background Art

FIG. 23 shows a structure of the components utilizing an internal voltage in a dynamic semiconductor memory device (referred to as "DRAM" hereinafter). A structure of a memory cell array is schematically shown in FIG. 23. In the memory cell array, a plurality of memory cells MC are arranged in a matrix of rows and columns. A word line WL is disposed corresponding to each row of memory cells. Also, a pair of bit lines is disposed corresponding to each column of memory cells. Memory cells of a row are connected to a corresponding word line WL. Also, memory cells of a column are connected to a corresponding bit line pair. In FIG. 23, two word lines WL1 and WL2, and one pair of bit lines BL and /BL are shown representatively.

A memory cell MC1 is disposed corresponding to the crossing of word line WL1 and bit line BL. A memory cell MC2 is disposed corresponding to the crossing of word line WL2 and bit line /BL. Memory cell MC1 includes a capacitor Ca1 storing information in the form of electric charges, and an access transistor MT1 rendered conductive in response to a signal potential on a corresponding word line WL1 for connecting capacitor Ca1 to bit line BL to read out the information stored in capacitor Ca1 to corresponding bit line BL. Similar to memory cell MC1, memory cell MC2 includes a capacitor Ca2, and an access transistor MT2 rendered conductive in response to a signal potential on a corresponding word line WL2. Both access transistors MC1 and MC2 are formed of an n channel MOS transistor (insulated gate field effect transistor).

A precharge/equalize circuit PE is provided at bit line pair BL and /BL to precharge bit lines BL and /BL to an intermediate potential VBL in a standby mode. Precharge/equalize circuit PE includes an equalize transistor T1 responsive to an equalize signal EQ for short-circuiting bit lines BL and /BL electrically, and precharge transistors T2 and T3 rendered conductive in response to equalize signal EQ for transmitting precharge potential VBL to bit lines BL and /BL. Transistors T1–T3 are formed of an n channel MOS transistor. Precharge potential VBL is set at an intermediate potential (VCC/2:VSS=0V) between operating power supply voltage VCC and ground voltage VSS.

A cell plate voltage VCP of an intermediate potential level is applied to a cell plate electrode (common electrode: node not connected to access transistors MT1 and MT2) of memory cell capacitors Ca1 and Ca2. Precharge voltage VBL and cell plate voltage VCP are supplied from an intermediate voltage generation circuit MV provided within the DRAM. The reason why precharge voltage VBL and cell plate voltage VCP are set to the level of intermediate potential VCC/2 will be described afterwards. An operation of the DRAM of FIG. 23 will be described with reference to the operation waveform diagram of FIG. 24.

In a DRAM, an operation cycle (a standby cycle in a waiting state and an active cycle during which a memory cell select operation is carried out) is determined by an externally applied row address strobe signal /RAS. When row address strobe signal /RAS attains a high level (logical high), the DRAM enters a standby cycle in which the internal memory cell array is maintained at a precharge state. During this standby cycle, equalize signal EQ attains a high level, all transistors T1–T3 in precharge/equalize circuit PE attain an ON state, and bit lines BL and /BL are precharged to the level of precharge voltage VBL supplied from intermediate voltage generation circuit MV. Word lines WL1 and WL2 attain a non-selected state, and are maintained at a low level (logical low) of ground voltage.

At the fall of row address strobe signal /RAS to a low level, an active cycle is initiated to begin a memory cell select operation. In response to this fall of row address strobe signal /RAS, equalize signal EQ is driven to a low level, and all transistors T1–T3 in precharge/equalize circuit PE are turned off. In this state, bit lines BL and /BL attain a floating state at a precharge voltage VBL.

Then, in response to the fall of this row address strobe signal /RAS, an externally applied row address signal is latched into and decoded. Word line WL disposed corresponding to the row addressed by this row address signal is selected, and the potential of the selected word line WL is driven to a high level (in general, a voltage of a level higher than operating power supply voltage VCC). At the rise of the potential of the selected word line WL, access transistor MT of memory cell MC connected to the selected word line WL is rendered conductive, whereby memory cell capacitor Ca is electrically connected to a corresponding bit line. For the sake of simplification, it is assumed that word line WL1 is selected here. In this state, access transistor MT1 of memory cell MC1 is turned on, whereby capacitor Ca1 is electrically connected to bit line BL. Charge transportation occurs between bit line BL and capacitor Ca1 according to the amount of stored charge (stored information) in memory cell capacitor Ca1, whereby the potential of bit line BL changes. FIG. 24 shows a state in which memory cell MC1 stores data of a high level, and the potential of bit line BL is increased. Since a memory cell capacitor is not connected in the other bit line /BL, bit line /BL maintains the voltage level of precharge voltage VBL.

When the potential difference between bit lines BL and /BL is great enough, a sense amplifier not shown is activated. The potential of bit lines BL and /BL is amplified differentially, whereby the potential of bit line BL of a higher level is set to the level of power supply voltage VCC, and the potential of bit line /BL of a lower potential is set to the level of ground voltage VSS. Then, a column address signal not shown is supplied and decoded, whereby a memory cell of the column addressed by this decoded column address signal is selected. Data writing/reading is carried out with respect to the memory cell on the selected column.

Upon completion of an access operation on a memory cell, row address strobe signal /RAS is driven to a high level, and the potential of the selected word line WL is driven to a low level. Access transistor MT1 of memory cell MC connected to the selected word line WL1 is turned off. Then, the sense amplifier is deactivated, and the latch operation of the potential of bit lines BL and /BL is ceased. Then, equalize signal EQ is driven to a high level, whereby bit lines BL and /BL are precharged to a precharge voltage VBL at the level of intermediate voltage VCC/2 by precharge/equalize circuit PE.

It is appreciated from the operation waveform diagram of FIG. 24 that the voltages of bit lines BL and /BL make a transition from precharge voltage VBL to operating power supply voltage VCC or ground voltage VSS. Therefore, the voltage amplitude of bit lines BL and /BL becomes VCC/2, so that the time required for setting bit lines BL and /BL to a high level or a low level according to the readout memory cell data is shortened. This means that the voltage levels of bit lines BL and /BL can be ascertained at a faster timing. As a result, the access for a selected memory cell can be speeded up to allow high speed access.

The reason why cell plate voltage VCP is set to intermediate voltage VCC/2 is set forth in the following. When the storage capacity of a DRAM and the integration density are both increased, the occupying area of a memory cell is reduced to cause reduction in the occupying area of the memory cell capacitor. A potential difference (readout voltage) ΔV of bit lines BL and /BL shown in FIG. 24 is sensed and amplified by a sense amplifier not shown, whereby memory cell data is read out. It is therefore desired to increase this readout voltage ΔV as high as possible in order to carry out a sensing operation accurately. The magnitude of readout voltage ΔV is substantially proportional to the ratio of a capacitance Cb of bit line BL or /BL and a capacitance Cs of memory cell capacitor Ca, i.e. Cs/Cb. Therefore, it is necessary to maximize the capacitance of memory cell capacitor Ca. The capacitance value of a memory cell capacitor is determined by the opposing area and the distance between a storage node (an electrode node connected to access transistor) and a cell plate. The thickness of an insulating film of memory cell capacitor Ca is made as thin as possible in order to realize a capacitance value sufficient for a memory cell capacitor. In order to ensure the breakdown voltage characteristics of a memory cell capacitor including such a thin capacitor insulating film, an intermediate voltage VCC/2 is applied as cell plate voltage VCP to maintain the voltage applied across the storage node and the cell plate of memory cell capacitor Ca to the level of intermediate voltage VCC/2.

FIGS. 25 shows an example of a conventional intermediate voltage generation circuit. Referring to FIG. 25, an intermediate voltage generation circuit includes a first voltage generation section VG1 for generating a first voltage from a voltage VCC on a power supply node 4*a* and a voltage VSS on a ground node 4*b*, a second voltage generation section VG2 for generating a second voltage from voltage VCC on power supply node 4*a* and voltage VSS on ground node 4*b*, and an output circuit OUT connected between power supply node 4*a* and ground node 4*b* for generating an internal voltage VO of a predetermined voltage level according to first and second voltages generated from voltage generation sections VG1 and VG2.

First voltage generation section VG1 includes a resistance element R1 of high resistance connected between power supply node 4*a* and an internal node 1*a*, a resistance element R2 of high resistance connected between internal nodes 1*a* and 1*b*, and n channel MOS transistors Q1 and Q2 connected in series between internal node 1*b* and ground node 4*b* and operating in a diode mode. Each of MOS transistors Q1 and Q2 has its gate and drain connected to each other (diode-connected), and operates in a diode mode by a small current from resistance elements R1 and R2.

Second voltage generation section VG2 includes p channel MOS transistors Q3 and Q4 connected in series between power supply node 4*a* and internal node 2*b*, a resistance element R3 of high resistance connected between internal nodes 2*b* and 2*a*, and a resistance element R4 of high resistance connected between internal node 2*a* and ground node 4*b*. Each of MOS transistors Q3 and Q4 has its gate and drain connected to each other, and operates in a diode mode by a small current from resistance elements R3 and R4.

A first voltage is generated from internal node 1*a*, and a second voltage is generated from internal node 2*a*.

Output circuit OUT includes an n channel MOS transistor Q5 connected between power supply node 4*a* and an output node 3, and having its gate connected to internal node 1*a*, and a p channel MOS transistor Q6 connected between output node 3 and ground node 4*b*, and receiving a second voltage on internal node 2*a* at its control electrode node (gate). The operation will be described hereinafter.

Respective resistance values of resistance elements R1 and R2 are set to be sufficiently greater than the ON resistance (channel resistance) of n channel MOS transistors Q1 and Q2. In this state, MOS transistors Q1 and Q2 operate in a diode mode to cause a voltage drop of a threshold voltage VTN. Therefore, the voltage on internal node 1*b* attains the level of 2·VTN (ground voltage VSS is 0V). When the resistance values of resistance elements R1 and R2 each are set to a value of R, a voltage of a level which is the potential difference between power supply node 4*a* and internal node 1*b* resistance-divided by the ratio of 1:1 is applied to internal node 1*a*. More specifically, a voltage of level:

$$(VCC+2\cdot VTN)/2=VCC/2+VTN$$

is applied as the first voltage from internal node 1*a* to the gate of MOS transistor Q5. Similarly in the second voltage generation section, the resistance values of resistance elements R3 and R4 are set sufficiently greater than the ON resistance (channel resistance) of MOS transistors Q3 and Q4. MOS transistors Q3 and Q4 operate in a diode mode, whereby a voltage drop of an absolute value of respective threshold voltages is generated thereacross. Therefore, the potential of internal node 2*b* becomes VCC−2·|VTP|. Since the resistance values of resistance elements R3 and R4 are equal to each other and the voltages across resistance elements R3 and R4 are equal to each other, the potential of internal node 2*a* is represented by:

$$VCC/2-|VTP|$$

In output circuit OUT, the voltage level applied to the control electrode node (gate) of MOS transistor Q5 is lower than power supply voltage VCC applied to power supply node 4*a*. Therefore, MOS transistor Q5 operates in a source follower mode, whereby MOS transistor Q5 transmits a voltage of the gate voltage minus the threshold voltage to output node 3. In other words, MOS transistor Q5 provides a potential of VCC/2 to output node 3. When the potential VO of output node 3 becomes higher than the level of VCC/2, the gate-source potential of MOS transistor Q5 becomes lower than threshold voltage VTN, whereby MOS transistor Q5 is turned off. In contrast, when voltage VO of output node 3 becomes lower than VCC/2, the gate-source voltage of MOS transistor Q5 becomes higher than threshold voltage VTN thereof, whereby MOS transistor Q5 is turned on. A current is supplied from power supply node 4*a* to node 3 to increase the potential thereof.

Since MOS transistor Q6 has its gate potential higher than the potential of the drain thereof, i.e. the potential of ground node 4*b*, MOS transistor Q6 similarly operates in a source follower mode, to discharge the potential of output node 3 to the level of an absolute value of the threshold voltage plus the gate potential thereof. More specifically, MOS transistor Q6 drives voltage VO of output node 3 to the voltage level of VCC/2. When voltage VO of output node 3 becomes higher than VCC/2, MOS transistor Q6 has the gate-source potential made higher than the threshold voltage to be turned on. As a result, the potential of output node 3 is lowered. When voltage VO of output node 3 becomes lower than VCC/2, the gate-source potential of MOS transistor Q6 becomes lower than threshold voltage VTP, whereby MOS transistor Q6 is turned off.

Therefore, in output circuit OUT, MOS transistors Q5 and Q6 operate in a push-pull mode where one attains an ON state and the other an OFF state. Since MOS transistors Q5 and Q6 operate with their gate-source voltages being in the proximity of a region equal to respective threshold voltages, i.e. since MOS transistors Q5 and Q6 operate at the boundary of an ON state and an OFF state, almost no through current flows from power supply node 4a to ground node 4b to reduce power consumption. Furthermore, only a small current is required in voltage generation sections VG1 and VG2 for operating MOS transistors Q1–Q4 in a diode mode. The resistance values of resistance elements R1–R4 are set high enough, and the current flowing therethrough is set low enough. Therefore, power consumption is small.

FIG. 26 shows another structure of a conventional intermediate voltage generation circuit. Referring to FIG. 26, the intermediate voltage generation circuit includes a voltage generation section VG for generating a reference voltage, and an output circuit OUT for producing an intermediate voltage VO of a predetermined voltage level according to the reference voltage from voltage generation section VG. Voltage generation section VG includes a resistance element R5 of high resistance connected between power supply node 4a and internal node 1, a diode-connected n channel MOS transistor Q7 connected between internal node 1 and an internal node 7, a diode-connected p channel MOS transistor Q8 connected between internal nodes 7 and 2, and a resistance element R6 of high resistance connected between internal node 2 and ground node 4b. Like the structure shown in FIG. 25, output circuit OUT includes an channel MOS transistor Q5 for charging output node 3, and a p channel MOS transistor Q6 for discharging output node 3.

The resistance values of resistance elements R5 and R6 are set sufficiently greater than the ON resistance (channel resistance) of MOS transistors Q7 and Q8. MOS transistors Q7 and Q8 operate in a diode mode to cause a voltage drop of respective threshold voltages. When the resistance values of resistance elements R5 and R6 are both equal to R, the threshold voltages of MOS transistors Q7 and Q8 are VTN and VTP, respectively, and the current flowing from power supply node 4a to ground node 4a via voltage generation section VG is I, the following equation is obtained.

$$2 \cdot I \cdot R + VTN + |VTP| = VCC$$

$$I \cdot R = (VCC - VTN - |VTP|)/2$$

Therefore, voltages VN1 and VN2 of internal nodes 1 and 2 are respectively obtained by the following equations.

$$\begin{aligned} VN1 &= VCC - I \cdot R \\ &= VCC/2 + (VTN + |VTP|)/2 \end{aligned}$$

-continued $$\begin{aligned} VN2 &= VN1 - VTN - |VTP| \\ &= VCC/2 - (VTN + |VTP|)/2 \end{aligned}$$

MOS transistors Q5 and Q6 each operate in a source follower mode, whereby a voltage of the gate potential minus the threshold voltage is transmitted from the drain to source. Therefore, a voltage VN3 from output node 3 is expressed by the following equation of:

$$VN3 = VCC/2 + (|VTP| - VTN)/2$$

Upon the rise of voltage VN3 output node 3, p channel MOS transistor Q6 is turned on, whereby the level of voltage VN3 of output node 3 is pulled down. In contrast, when the voltage level of output node 3 is lowered, MOS transistor Q5 is turned on, whereby the voltage level of voltage VN3 from output node 3 is raised. Since threshold voltages |VTP| and VTN are substantially equal to each other, the level of voltage VN3 provided from output node 3 is approximately VCC/2. Since MOS transistors Q5 and Q6 in output circuit OUT operate at the boundary region between an ON state and an OFF state and also in a push-pull manner according to the structure of the intermediate voltage generation circuit shown in FIG. 26, almost no current flows from power supply node 4a to ground node 4b, and the power consumption is low. Furthermore, since the resistance values of resistance elements R5 and R6 are high enough in voltage generation section VG, the current flow is extremely low to result in a low power consumption.

A DRAM is widely used in the application of portable equipments such as a notebook type personal computer. A device of low power consumption is particularly required in such portable equipments since a battery is used as the power source. Among the various measures for low power consumption, the approach of reducing the operating power supply voltage is most effective since power consumption is proportional to the second power of the operating power supply voltage. From this standpoint, a requirement of 1.8V±0.15 (1.65~1.95V) for an operating power supply voltage is imposed. Although the size of an MOS transistor is scaled down in accordance with reduction of the power supply voltage, a lowering of threshold voltage in accordance with reduction of the power supply voltage is generally difficult due to increase of subthreshold current as will be described hereinafter.

FIG. 27 shows the relationship between a gate voltage and a drain current of an N channel MOS transistor. Drain current Ids is plotted along the ordinate, and a gate voltage (a gate voltage with the source voltage as the reference) Vgs is plotted along the abscissa. The threshold voltage of an MOS transistor is defined as a gate voltage at which drain current of a certain amount is conducted. For example, in a MOS transistor having a gate width of 10 μm, threshold voltage Vth is defined as the gate voltage Vgs at which a current of 1 μA is conducted. Although drain current Ids is lowered exponentially when the gate voltage becomes lower than the threshold voltage in an MOS transistor, the drain current Ids does not become 0 even when the gate voltage Vgs becomes 0V.

When the threshold voltage of an MOS transistor is lowered from Vth1 to Vth2, the characteristic curve of this MOS transistor moves from curve I to curve II. In this state, the current flowing when gate voltage Vgs is 0V (subthreshold current) increases from I1 to I2. Therefore, there is a problem that the subthreshold current increases to result in greater power consumption if the threshold voltage is simply lowered. The characteristic of a p channel MOS transistor is obtained by inverting the sign of Vgs in FIG. 27, and causes similar problem. For example, the magnitude of a threshold voltage of a MOS transistor currently used in a DRAM has a value of approximately $$VTN=0.7\pm0.1V,\ |VTP|=0.75\pm0.1V.$$

FIG. 28 shows a relationship between voltage V1 and power supply voltage VCC of node la of the intermediate voltage generation circuit shown in FIG. 25. When power supply voltage VCC is less than 2·VTN, at least one of MOS transistors Q1 and Q2 is OFF, so that no current flows in first voltage generation section VG1. Therefore, voltage V1 on node 1*a* is raised according to power supply voltage VCC (V1=VCC).

When power supply voltage VCC exceeds 2·VTN, MOS transistors Q1 and Q2 are both turned on, whereby current flows from power supply node 4*a* to ground node 4*b* in first voltage operation section VG1. Therefore, voltage V1 of node 1*a* becomes VCC/2+VTN. When MOS transistors Q1 and Q2 have a threshold voltage VTN of the aforementioned value, 2·VTN=1.4±0.2V. Therefore, when power supply voltage VCC is lower than 1.4±0.2V, voltage V1 of node 1*a* becomes equal to operating voltage VCC, so that a voltage of a required level of VCC/2+VTN cannot be generated. In contrast, minimum permissible value of power supply voltage VCC is 1.8−0.15=1.65V. The voltage required for first voltage generation section VG1 to operate properly is 1.4+0.2=1.6V, so that the difference therebetween is 0.05V, which is an extremely small value. Similarly in second voltage generation section VG2, a desired voltage VCC/2−|VTP| is supplied when power supply voltage VCC is greater than 2|VTP|. When power supply voltage VCC is smaller than 2|VTP|, the potential of node 2*a* of second voltage generation section VG2 attains the level of ground voltage, i.e. 0V.

When noise is generated on the power supply voltage to cause reduction in the level of power supply voltage VCC, or when noise is generated on the ground voltage to cause increase thereof greater than 0V in a general operating state, the voltages of nodes 1*a* and 2*b* become V1=VCC and V2=VSS, respectively. Therefore, there is a problem that voltage VO of a desired voltage level (intermediate voltage VCC/2) cannot be supplied.

The above-described situation applies also in the intermediate voltage generation circuit shown in FIG. 26. More specifically, when power supply voltage VCC becomes lower than the sum of the absolute values of the threshold voltages of MOS transistors Q7 and Q8 in FIG. 26, i.e. lower than 0.7+0.1+0.75+0.1=1.65V, MOS transistors Q7 and Q8 are turned off, whereby the voltage of node 1 attains the level of power supply voltage VCC and the potential of node 2 attains the level of ground voltage.

Therefore, the gate and drain of MOS transistor Q5 both attain the level of power supply voltage VCC, and the gate and drain of MOS transistor Q6 both attain the level of ground voltage VSS in output circuit OUT in both intermediate voltage generation circuits. Therefore, the difference between the gate voltage VCC and the source voltage (output voltage VO or VN3) of MOS transistor Q5 becomes smaller than the threshold voltage of MOS transistor Q5, whereby MOS transistor Q5 is turned off. More specifically, the gate-source voltage of MOS transistor Q5 in output circuit OUT in FIG. 25 becomes VCC/2, whereby the gate-source voltage of MOS transistor Q5 becomes smaller than threshold voltage VTN because of VCC<2·VTN. Similarly, in MOS transistor Q6 according to the structure shown in FIG. 25, the gate-source voltage becomes VCC/2(<|VTP|), whereby MOS transistor Q6 is turned off. Therefore, MOS transistors Q5 and Q6 are both turned off, so that the level of voltage VO provided from output node 3 becomes unstable.

Similarly, according to the structure shown in FIG. 26, the potential difference VCC−VN3 between the gate and source (output node) in MOS transistor Q5 is:

$$VCC/2-(|VTP|-VTN)/2$$

Since power supply voltage VCC is smaller than the sum of the threshold voltages of MOS transistors Q7 and Q8, the gate-source potential difference of MOS transistor Q5 becomes smaller than threshold voltage VTN from this equation. Therefore, MOS transistor Q5 is turned off. Similarly in MOS transistor Q6, the gate-source voltage −VN3 is:

$$VCC/2+(|VTP|-VTN)/2$$

In this case, the gate-source voltage of MOS transistor Q6 becomes smaller than |VTP|, whereby MOS transistor Q6 is turned off. Thus, MOS transistors Q5 and Q6 are both turned off, so that voltage VO (VN3) from output node 3 becomes unstable.

When operating voltage VCC attains a stable state while not attaining the level of a predetermined voltage (2·VTN, 2|VTP| or VTN+|VTP|) after power is turned on, the gate-source voltage of MOS transistor Q5 becomes lower than the threshold voltage (VCC−VTN<VTN) to maintain the transistor Q5 constantly OFF. Therefore, there is a problem that a desired voltage is not generated.

Furthermore, a desired voltage cannot be generated stably in the case where the absolute value of the threshold voltage of an MOS transistor which is a constituent element is increased according to variation in the manufacturing parameter.

SUMMARY OF THE INVENTION

An object of the present invention is to provide a voltage generation circuit that has margin with respect to power supply voltage enlarged.

Another object of the present invention is to provide a voltage generation circuit suitable for a DRAM application that can generate an internal voltage of a desired level stably in a low power supply voltage.

A voltage generation circuit according to the present invention includes a first MOS transistor of a first conductivity type having one electrode node coupled to a first power supply node and another electrode node connected to an output node for generating a voltage of a predetermined voltage level, a second MOS transistor of a second conductivity type having one electrode node coupled to a second power supply node and another electrode node connected to an output node, and a voltage generation section to receive voltages on at least third and fourth power supply nodes for generating first and second voltages and supplying the same to control electrode nodes of first and second MOS transistors, respectively.

The difference between the first and second voltages is set equal to the sum of the absolute values of the threshold voltages of the first and second MOS transistors. The voltage of the third power supply node is set to a level higher than two times the difference between the voltage provided from the output node and a measurement reference voltage that is a measurement reference value for the voltage value of the output node. The voltage of the fourth power supply node is set lower than the level of a particular measurement reference voltage.

By taking advantage of a voltage greater than two times the level of a voltage to be output and a voltage of a level lower than measurement reference voltage that provides measurement reference for the voltage supplied from the output node, the voltage difference between the third and fourth power supply nodes is set great enough. Since first and second voltages are generated having a voltage difference equal to the sum of absolute values of the threshold voltages of first and second MOS transistors according to these third and fourth voltages, the first and second voltages can be generated more stably than in the case utilizing a power supply voltage and a ground voltage. This prevents the first and second MOS transistors from being turned off. Therefore, a voltage of a desired level can be generated stably even under the condition of low power supply voltage.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
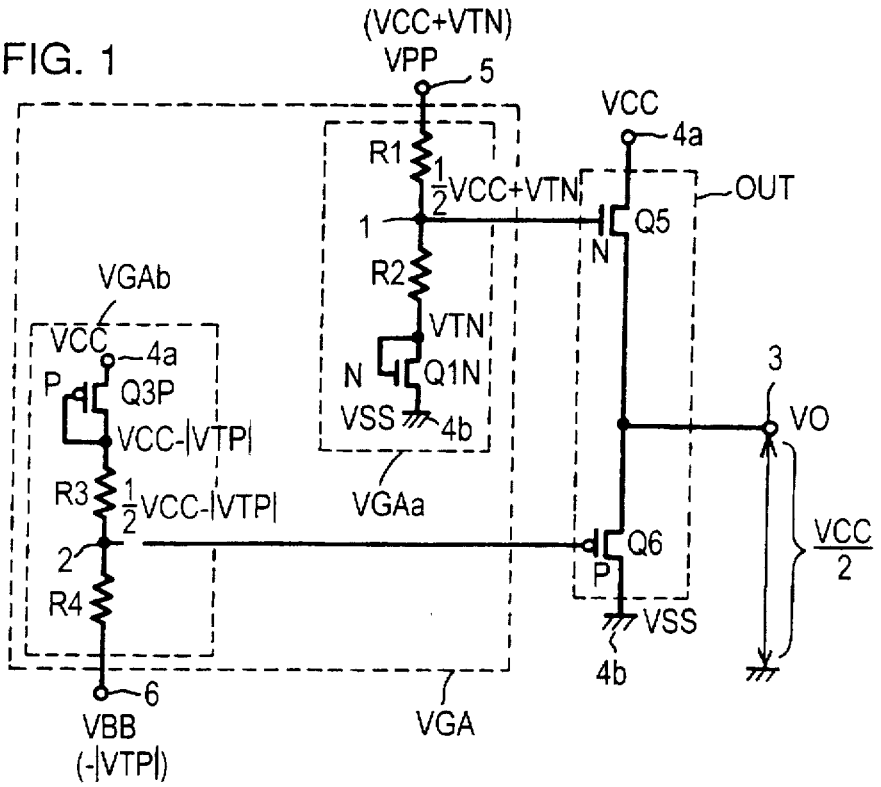
FIGS. 1–11 show a structure of a voltage generation circuit according to first to eleventh embodiments, respectively, of the present invention.

FIG. 1 shows a structure of a voltage generation circuit according to a first embodiment of the present invention. Referring to FIG. 1, the voltage generation circuit includes an output circuit OUT connected between a power supply node **4*a* as a first power supply node and a ground node 4*b* as a second power supply node for generating an internal voltage VO of a predetermined voltage level to an output node 3, and a voltage generation section VGA for generating first and second voltages determining the voltage level of voltage VO applied to output node 3 taking advantage of voltage VPP on third power supply node 5 and voltage VBB on fourth power supply node 6 and supplying the first and second voltages to output circuit OUT. Voltage VO supplied to output node 3 has a level of voltage VCC/2 as will be described afterwards. The voltage value of voltage VO of output node 3 is measured with the ground voltage on ground node 4*b* as a reference. More specifically, VO=VCC/2−VSS. Voltage VPP applied to third power supply node 5 has a level greater than two times the difference between voltage VO on output node 3 and measurement reference voltage VSS (0V) for voltage VO on output node 3. More specifically, voltage VPP on third power supply node 5 has a voltage level higher than power supply voltage VCC. A voltage lower than the ground voltage which is this measurement reference voltage, i.e. a negative voltage, is applied to fourth power supply node 6**.

Output circuit OUT includes an n channel MOS transistor Q5 having one electrode node (drain) connected to first power supply node **4*a* and another electrode node (source) connected to output node 3, and a p channel MOS transistor Q6 having one electrode node (drain) connected to ground node 4*b* as a second power supply node and another electrode node (source) connected to output node 3**.

Voltage generation section VGA includes a first voltage generation section VGAa for receiving voltage VPP on third power supply node 5 and voltage VSS on ground node 4 to generate a first voltage and supplying the same to the gate (control electrode node) of MOS transistor Q5, and a second voltage generation section VGAb receiving voltage VCC on power supply node **4*a* and voltage VBB on source power supply node 6** to generate a second voltage which is applied to the gate of MOS transistor Q6.

First voltage generation section VGAa includes a resistance element R1 of high resistance connected between third power supply node 5 and internal node 1, and a resistance element R2 of high resistance and an n channel MOS transistor Q1N connected in series between node 1 and ground node **4*b***. MOS transistor Q1N has its gate and drain connected to each other (diode-connected) and operates in a diode mode.

Second voltage generation section VGAb includes a p channel MOS transistor Q3P and a resistance element R3 of high resistance connected in series between power supply node **4*a* and node 2, and a resistance element R4 of high resistance connected between node 2 and fourth power supply node 6**. MOS transistor Q3C has its gate and drain connected to each other, and operates in a diode mode. The resistance values of resistance elements R1 and R2 are set greater than the ON resistance (channel resistance) of MOS transistor Q1N. The resistance values of resistance elements R1 and R4 are set to a value greater than the ON resistance of MOS transistor Q3P. The operation thereof will be described hereinafter. In the following, the magnitude of a voltage is indicated with ground voltage as the measurement reference voltage.

High voltage VPP applied to third power supply node 5 is set to the level of VCC+VTN. Here, VTN refers to the threshold voltage of MOS transistor Q1N. Voltage VBB applied to fourth power supply node 6 is set to the voltage level of −|VTP|. Here, VTP refers to the threshold voltage of MOS transistor Q3P. In the following description, all n channel MOS transistors have a threshold voltage of VTN, and all p channel MOS transistors have a threshold voltage of VTP. The resistance values of resistance elements R1–R4 are set sufficiently high. MOS transistors Q1N and Q3P each operate in a diode mode to cause a voltage drop of an absolute value of the threshold voltage. Resistance elements R1 and R2 have the same resistance value. Also, resistance elements R3 and R4 have the same resistance value. Resistance elements R1 and R2 have the same resistance value, and the voltage across resistance elements R1 and R2 have the same value. Therefore, voltage V1 of node 1 is obtained by the following equation:

$$\begin{aligned} V1 &= (VCC + VTN - VTN)/2 + VTN \\ &= VCC/2 + VTN \end{aligned} \quad (1)$$

In second voltage generation section VGAb, the voltage across resistance elements R3 and R4 is identical. Therefore, voltage V2 supplied from node 2 is obtained by the equation of:

$$\begin{aligned} V2 &= (VCC - |VTP| - (-|VTP|))/2 - |VTP| \\ &= VCC/2 - |VTP| \end{aligned} \quad (2)$$

MOS transistor Q5 has a gate potential (VCC/2−VTN≧0) lower than the drain potential (power voltage VCC) to operate in a source follower mode. Therefore, MOS transistor Q5 transfers a voltage of VCC/2 to output node 3. MOS transistor Q6 has a gate potential greater than the drain potential, and clamps the voltage of output node 3 to the level of VCC/2. In response to lowering of voltage VO at output node 3, the gate-source voltage of MOS transistor Q5 is increased, whereby MOS transistor Q5 conducts. Current is supplied from power supply node 4a to output node 3 to raise the level of voltage VO on output node 3. When voltage VO at output node 3 rises, the gate-source voltage of MOS transistor Q6 is increased to cause conduction thereof. Therefore, current flows from output node 3 to ground node 4b to cause reduction in the level of voltage VO. By this push-pull operation, voltage VO of output node 3 is maintained at the voltage level of VCC/2.

Figure 25:
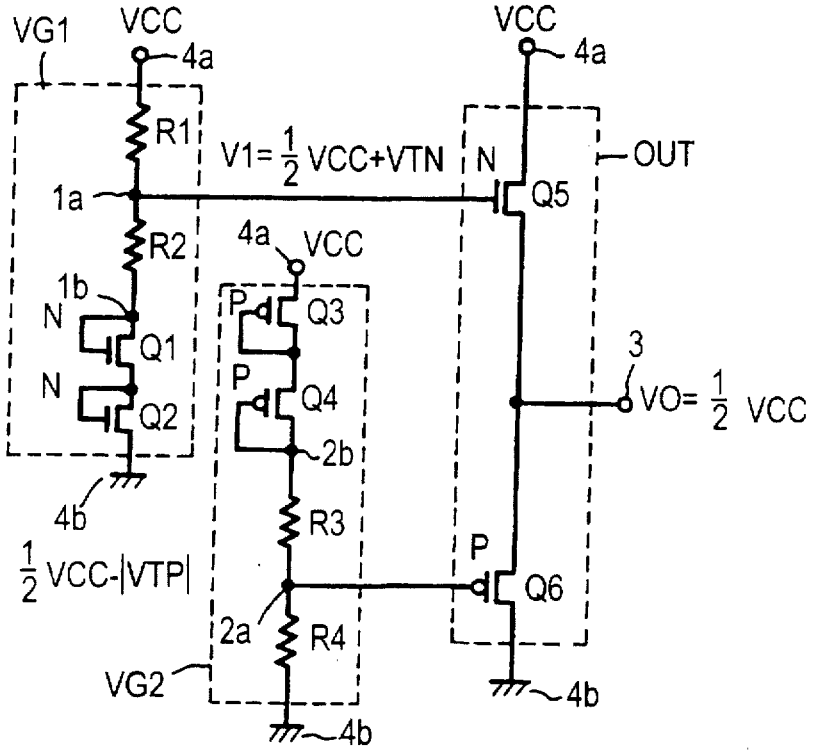
FIG. 25 PRIOR ART
FIG. 25 shows a structure of a conventional intermediate voltage generation circuit.
Figure 26:
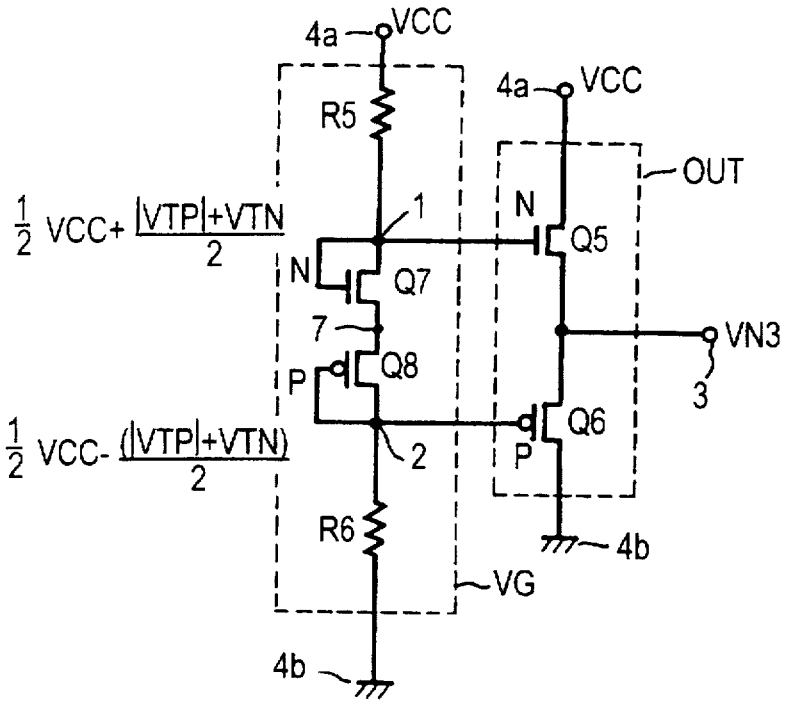
FIG. 26 PRIOR ART
FIG. 26 shows another structure of a conventional intermediate voltage generation circuit.
Figure 27:
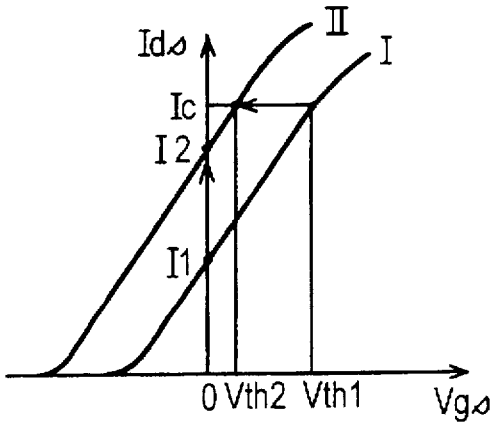
FIG. 27 PRIOR ART
FIG. 27 shows a subthreshold current characteristic of a MOS transistor.
Figure 28:
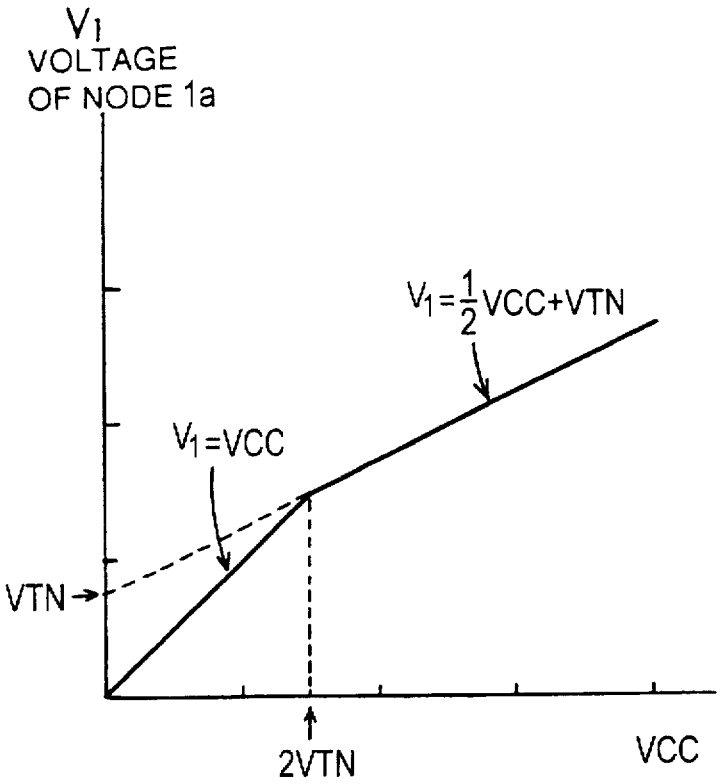
FIG. 28 PRIOR ART
FIG. 28 is a diagram for explaining problems of a conventional intermediate voltage generation circuit.

In comparison to the structure shown in FIG. 25, it is appreciated from the structure of the voltage generation circuit shown in FIG. 1 that MOS transistors fewer by one in number are required in each of voltage generation sections VGAa and VGAb. Also, voltage VPP on third power supply potential 5 is set higher by the absolute value of the threshold voltage of MOS transistor Q1N, and voltage VBB on fourth power supply node 6 is set lower by the absolute value of the threshold voltage of MOS transistor Q3P. Therefore, in contrast to a conventional structure, the voltage difference between power supply nodes in first and second voltage generation sections VGAa and VGAb in the present invention is increased by the absolute value of the threshold voltage. In first voltage generation section VGAa, VCC+VTN>VTN. When power supply voltage VCC is generated to raise the level of high voltage VPP, MOS transistor Q1N can be turned on reliably to generate voltage VCC/2+VTN stably. Similarly in second voltage generation section VGAb, when the voltage level of voltage VBB is −|VTP|, VCC−|VTP|>−|VTP|, so that current flows to second voltage generation section VGAb as long as power supply voltage VCC is generated. Therefore, voltage of VCC/2−|VTP| can be generated stably.

More specifically, current is conducted in first and second voltage generation sections VGAa and VGAb even when the level of power supply voltage VCC is low. A voltage of a desired level can be generated stably to increase the operation range of power supply voltage VCC. In other words, voltage VO of a predetermined level can be generated from output node 3 even when power supply voltage VCC is lowered to approximately 0V.

The difference between voltage VO on output node 3 and voltage V1 on node 1 is approximately the threshold voltage VTN. Also, the voltage difference between output node 3 and internal node 2 is approximately |VTP|. MOS transistors Q5 and Q6 operate at the boundary region between an ON state and an OFF state. Almost no current flows from power supply node 4a to ground node 4b in output circuit OUT. Therefore, voltage of the desired level can be generated at low power consumption.

In FIG. 1, a MOS transistor of a sufficiently great channel resistance (ON resistance) can be used for resistance elements R1–R4.

Second Embodiment

Figure 2:
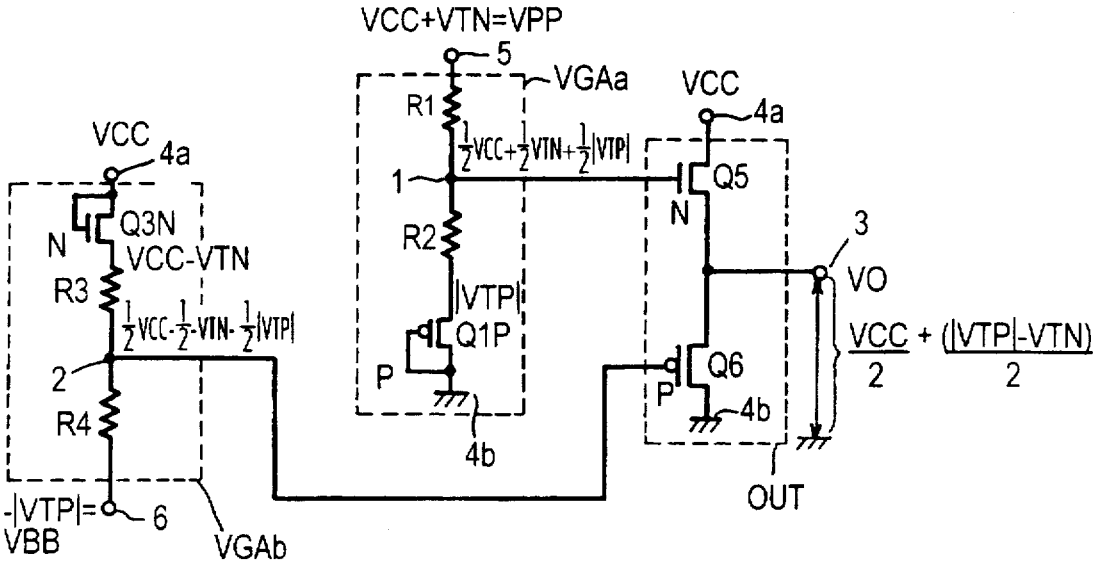

FIG. 2 shows a structure of a voltage generation circuit according to a second embodiment of the present invention. The voltage generation circuit of FIG. 2 is similar to that shown in FIG. 1 except that a diode-connected p channel MOS transistor Q1P is used instead of n channel MOS transistor Q1N in first voltage generation section VGAa, and a diode-connected n channel MOS transistor Q3N is used instead of p channel MOS transistor Q3P in second voltage generation section VGAb.

The resistance values of resistance elements R1 and R2 are set to a value sufficient greater than the channel resistance of p channel MOS transistor Q1P. Also, the resistance values of resistance elements R3 and R4 are set to a value sufficiently greater than the channel resistance of n channel MOS transistor Q3N. Resistance elements R1 and R2 have equal resistance values, and resistance elements R3 and R4 have equal resistance values. Voltage V1 on node 1 and voltage V2 on node 2 are provided by the following equations because MOS transistors Q1 and Q3N operate in a diode mode.

$$\begin{aligned} V1 &= (VCC + VTN - |VTP|)/2 + |VTP| \\ &= VCC/2 + (VTN + |VTP|)/2 \\ V2 &= (VCC - VTN + |VTP|)/2 - |VTP| \\ &= VCC/2 - (VTN + |VTP|)/2 \end{aligned}$$

MOS transistors Q5 and Q6 operate in a source follower mode. Therefore, voltage VO of output node 3 is provided by the following equation of:

$$VO = VCC/2 + (|VTP| - VTN)/2 \quad (3)$$

Since the absolute value of threshold voltages VTN and |VTP| are substantially equal to each other, voltage VO from output node 3 attains the level of VCC/2.

MOS transistors Q5 and Q6 have respective gate-source voltages equal to the absolute value of the threshold voltages, and operate in the boundary region between an ON state and an OFF state also in the structure shown in FIG. 2. When MOS transistor Q5 is ON, MOS transistor Q6 is OFF. When MOS transistor Q6 is ON, MOS transistor Q5 is OFF. Since such a push-pull operation is implemented, almost no current flows from power supply node 4*a* to ground node 4*b* to realize low power consumption. Furthermore, in voltage generation sections VGAa and VGAb, the voltage between the power supply nodes is set to the sum of power supply voltage VCC and the threshold voltage VTN or |VTP| of the MOS transistor. MOS transistor Q1P and Q3N can be turned on reliably even when only one MOS transistor is included and power supply voltage VCC is low (even when VCC=0V in principle). Therefore, a voltage of a predetermined voltage level can be generated stably to be supplied to output circuit OUT. Even when the level of power supply voltage of VCC is low, a voltage of a desired level can be reliably generated from voltage generation section to enlarge the operating range of power supply voltage VCC according to the structure shown in FIG. 2.

Third Embodiment

Figure 3:
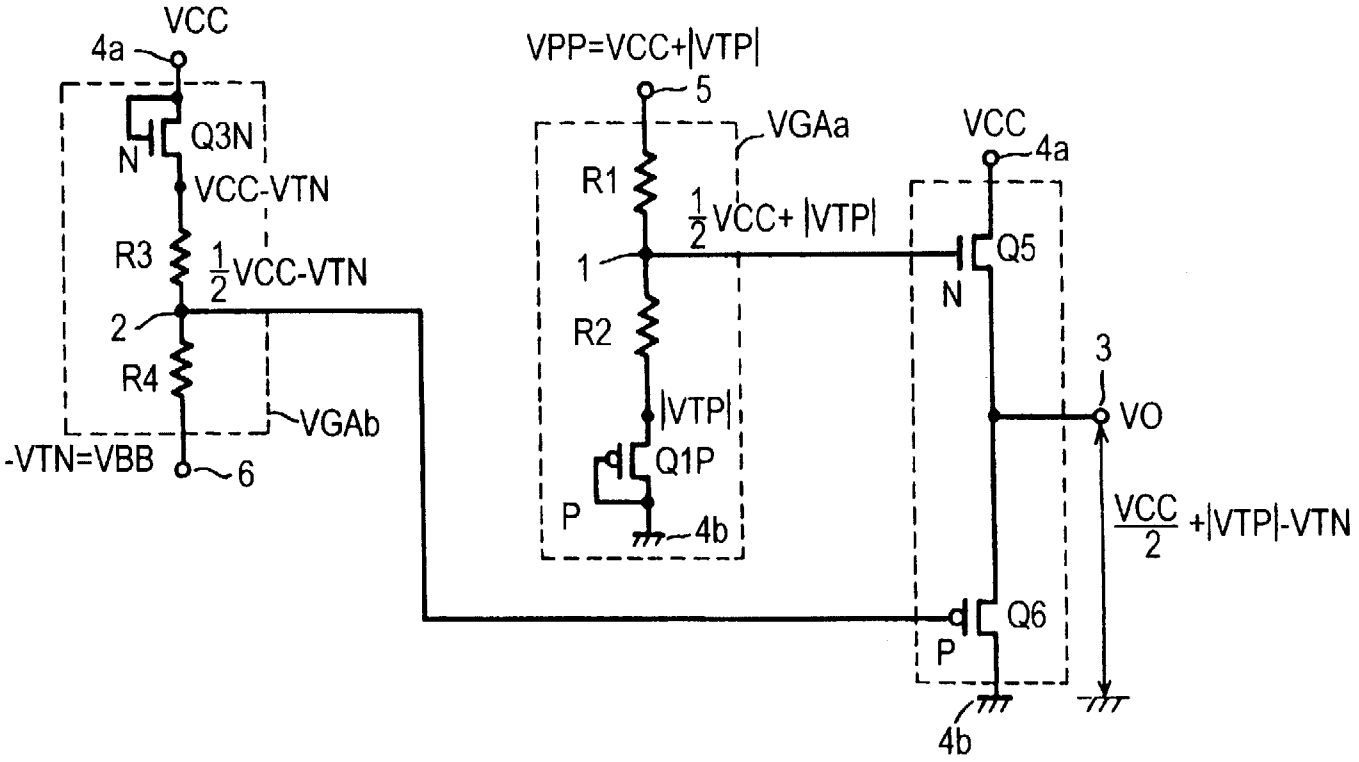

FIG. 3 shows a structure of a voltage generation circuit according to a third embodiment of the present invention. The voltage generation circuit of FIG. 3 has a structure similar to that of the voltage generation circuit of FIG. 2 except that the levels of the voltages supplied to third and fourth power supply nodes 5 and 6 differ. In the structure shown in FIG. 3, voltage VBB applied to third power supply node 5 is set to the level of voltage VCC+|VTP|. Voltage VPP applied to fourth power supply node 6 is set to the level of −VTN. Under this condition, voltage V1 of node 1 and voltage V2 of node 2 are obtained by the following equations:

$$\begin{aligned} V1 &= (VCC + |VTP| - |VTP|)/2 + |VTP| \\ &= VCC/2 + |VTP| \\ V2 &= (VCC - VTN - (-VTN))/2 - VTN \\ &= VCC/2 - VTN \end{aligned}$$

Since MOS transistors Q5 and Q6 operate in a source follower mode, voltage VO of output node 3 is expressed by:

$$VO = VCC/2 + |VTP| - VTN$$

Since threshold voltage VTN is substantially equal to |VTP|, voltage VO from output node 3 substantially attains the level of VCC/2.

Similar to the voltage generation circuit shown in the first and second embodiments, a voltage generation circuit of a wide operating range of power supply voltage VCC that operates at low power consumption can be realized according to the structure of FIG. 3.

Fourth Embodiment

Figure 4:
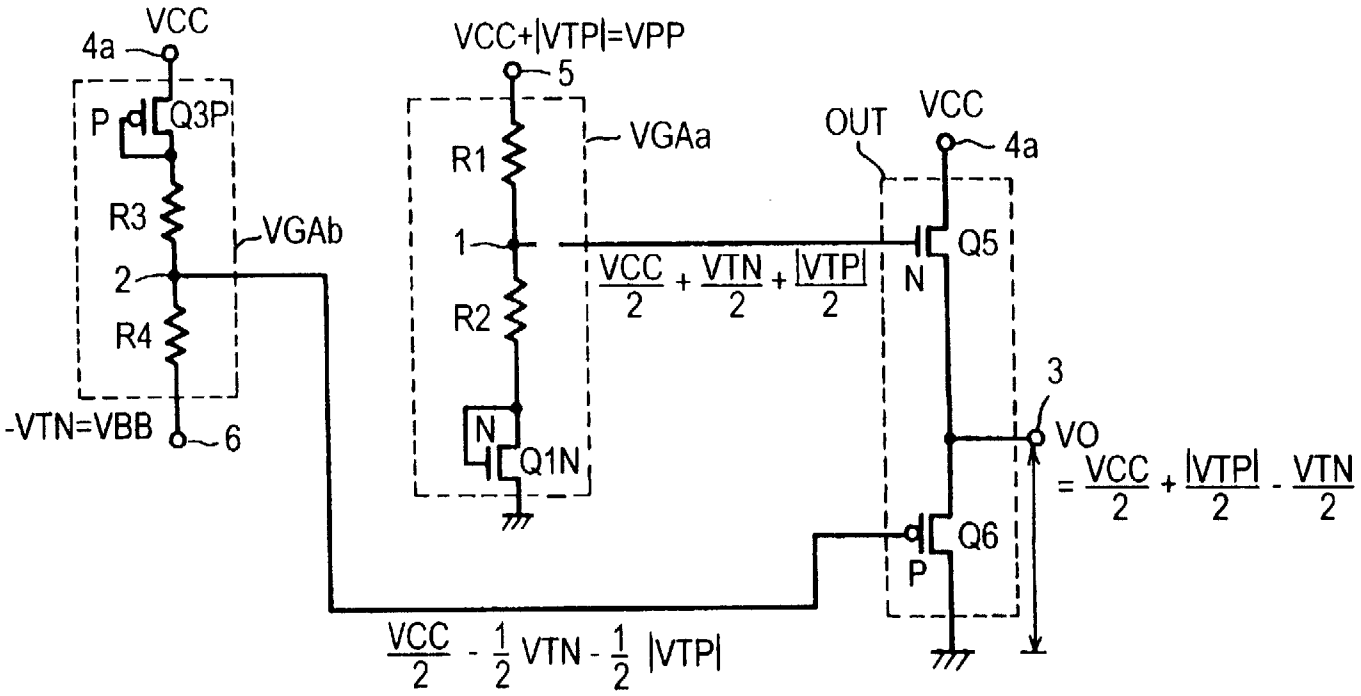

FIG. 4 shows a structure of a voltage generation circuit according to a fourth embodiment of the present invention. The voltage generation circuit of FIG. 4 is similar to the voltage generation circuit of FIG. 1 except for the following points. Namely, voltage VPP applied to third power supply node 5 is set to the voltage level of VCC+|VTP|. Voltage VBB applied to fourth power supply node 6 is set to the level of −VTN. VTP is the threshold voltage of p channel MOS transistor Q3P and VTN is the threshold voltage of n channel MOS transistor Q1N. According to the structure shown in FIG. 4, voltage V1 expressed by the following equation is supplied from node 1 of first voltage generation section VGAa.

$$\begin{aligned} V1 &= (VCC + |VTP| - VTN)/2 + VTN \\ &= VCC/2 + VTN/2 + |VTP|/2 \end{aligned}$$

Furthermore, voltage V2 expressed by the following equation is supplied from node 2 of second voltage generation section VGAb.

$$\begin{aligned} V2 &= (VCC - |VTP| + VTN)/2 - VTN \\ &= VCC/2 - VTN - |VTP|/2 \end{aligned}$$

Therefore, voltage VO expressed by the following equation is supplied from output node 3 of output circuit OUT.

$$VO = VCC/2 + |VTP|/2 - VTN/2$$

Since the threshold voltage VTN is substantially equal to |VTP|, output voltage VO substantially attains the level of VCC/2 according to the structure shown in FIG. 4.

Voltage VPP on third power supply node 5 and voltage VO (voltage with the level of ground voltage as the reference) of output node 3 satisfy the following relationship of:

$$VPP > 2VO$$

since, VCC+|VTP|−VCC−|VTP|+VTN=VTN>0

The relationship of this VPP>2·VO is satisfied also in the structure shown in FIG. 3. More specifically, $$VCC + |VTP| - VCC - 2|VTP| + 2 \cdot VTN = 2 \cdot VTN - |VTP| > 0$$

By supplying a voltage satisfying the relationship of VPP>2(VO−VSS) to the third power supply node, and by supplying a negative voltage to fourth power supply node 6, a voltage of a desired level can be generated stably even when the level of power supply voltage VCC is low.

Fifth Embodiment

Figure 5:
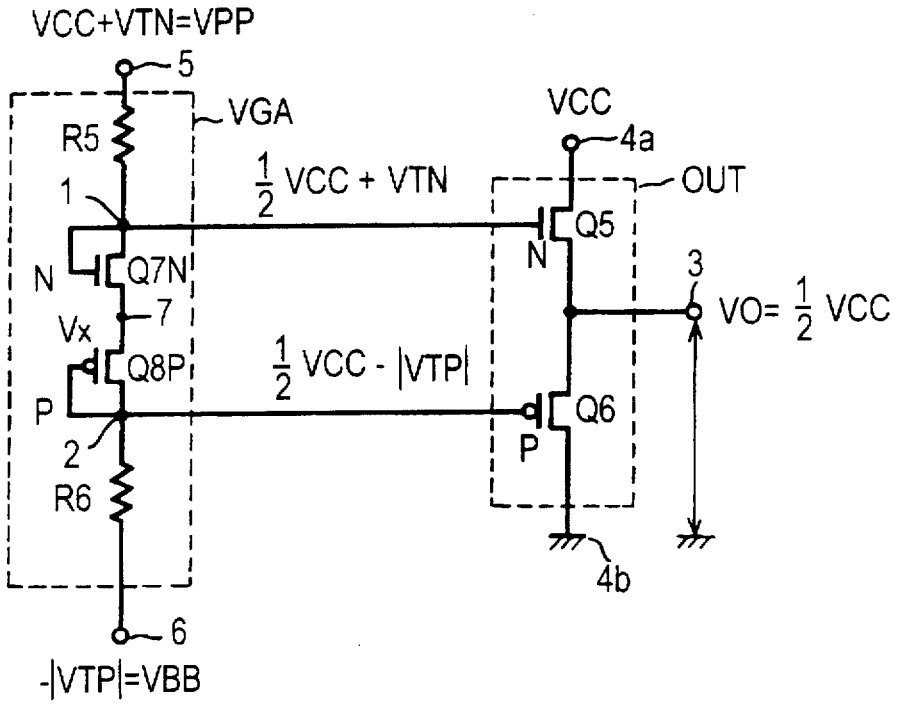

FIG. 5 shows a structure of a voltage generation circuit according to a fifth embodiment of the present invention. The voltage generation circuit of FIG. 5 generates the first and second voltages applied to the gates of MOS transistors Q5 and Q6 in output circuit OUT from voltage VPP on third power supply node 5 and voltage VBB on fourth power supply node 6. Voltage generation section VGA includes a resistance element R5 of high resistance connected between third power supply node 5 and internal node 1, an n channel MOS transistor Q7N connected betwee n internal nodes 1 and 7, a diode-connected p channel MOS transistor Q8P connected between nodes 7 and 2, and a resistance element R6 of high resistance connected between node 2 and fourth power supply node 6.

Voltage VPP applied to third power supply node 5 is set to the voltage level of VCC+VTN. Here, VTN refers to the threshold voltage of MOS transistor Q7N. Voltage VBB on fourth power supply node 6 is set to the voltage level of −|VTP|. VTP refers to the threshold voltage of MOS transistor Q8P. Resistance elements R5 and R6 have resistance values sufficiently greater than the channel resistances of MOS transistors Q7N and Q8P, and equal to each other. The operation thereof will be described hereinafter.

Let R to denote the resistance value of resistance elements R5 and R6; i the current flowing from third power supply node 5 to fourth power supply node 6; and Vx the voltage on node 7; then:

$$VCC+VTN-Vx=I\cdot R+VTN$$

$$Vx+|VTP|=|VTP|+I\cdot R \quad (4)$$

From equation (4), the following equation (5) is obtained.

$$I\cdot R=Vx \quad (5)$$

Substituting equation (5) into the first equation, the following equation (6) is obtained:

$$Vx=VCC/2 \quad (6)$$

From equation (6), voltages V1 and V2 on internal nodes 1 and 2, respectively, are expressed by the following equations.

$$V1=VCC/2+VTN$$

$$V2=VCC/2-|VTP|$$

MOS transistors Q5 and Q6 receive voltages V1 and V2, respectively, at their gates to operate in a source follower mode. Therefore, voltage of VCC/2 is supplied to output node 3.

MOS transistors Q5 and Q6 in output circuit OUT have gate-source voltages equal to the absolute value of the threshold voltages, and operate in the boundary region between an ON state and an OFF state in a structure shown in FIG. 5. Therefore, almost no current flows from power supply node 4*a* to ground node 4*b* in output circuit OUT. In voltage generation section VGA, two diode-connected MOS transistors are connected in series. However, the difference between voltage VPP on third power supply node 5 and voltage VBB on fourth power supply node 6 is VCC+VTN+|VTP|. In principle, MOS transistors Q7N and Q8P are both rendered conductive even when power supply voltage VCC is near 0V, and a small current flows to MOS transistors Q7N and Q8P via resistance elements R5 and R6. MOS transistors Q7N and Q8P operate in a diode mode. Therefore, a voltage of a desired level can be generated reliably even when power supply voltage VCC has a low level.

Thus, voltage VO of a desired level can be generated stably at low power consumption according to the structure of FIG. 5. A voltage generation circuit of a wide operating range of power supply voltage VCC can be implemented.

Sixth Embodiment

Figure 6:
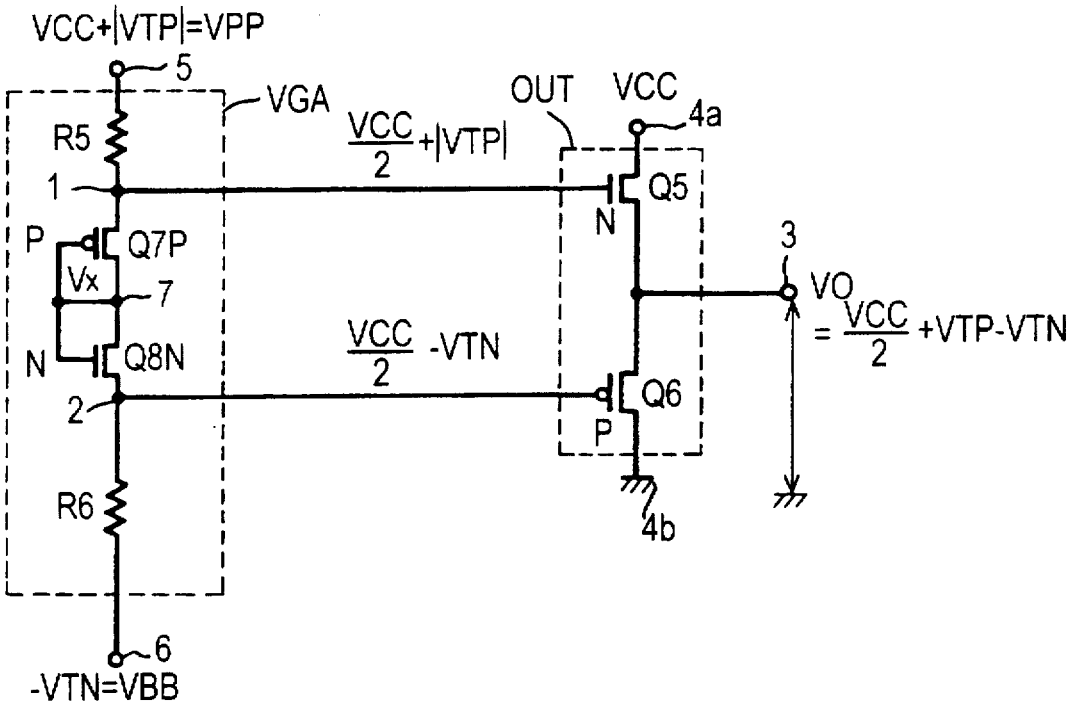

FIG. 6 shows a structure of a voltage generation circuit according to the sixth embodiment of the present invention.

Referring to FIG. 6, the voltage generation section VGA includes a resistance element R5 of high resistance connected between third power supply node 5 and node 1, a p channel MOS transistor Q7P connected between node 1 and node 7, a diode-connected n channel MOS transistor Q8N connected between nodes 2 and 7, and a resistance element R6 of high resistance connected between node 2 and fourth power supply node 6. Voltage VPP applied to third power supply node 5 is set to the level of VCC+|VTP|. Voltage VBB applied to fourth power supply node 6 is set to the level of −VTN. VTP and VTN show threshold voltages of MOS transistors Q7P and Q8N, respectively. The voltage on node 1 is applied to the gate of MOS transistor Q5 in output circuit OUT. The voltage on node 2 is supplied to the gate of p channel MOS transistor Q6 in output circuit OUT. The operation thereof will be described hereinafter.

It is assumed that the resistance values of resistance elements R5 and R6 is the value R equal to each other. This resistance value R is sufficiently higher than the channel resistance of MOS transistors Q7P and Q8N. In this case, MOS transistors Q7P and Q8N operate in a diode mode to cause a voltage drop of an absolute value of respective threshold voltages. From the voltage between third power supply node 5 and node 7, the following equation is obtained:

$$VCC+|VTP|-Vx=I\cdot R+|VTP|$$

where Vx is the voltage on node 7. Furthermore, the voltage across node 7 and fourth power supply node 6 is obtained by the following equation of:

$$Vx+VTN=I\cdot R+VTN$$

From the above two equations, $$Vx=VCC/2$$

Therefore, voltage V1 on node 1 and voltage V2 on node 2 are expressed by the following equation of:

$$V1=VCC/2+|VTP|$$

$$V2=VCC/2-VTN$$

In output circuit OUT, MOS transistor Q5 supplies to output node 3 the voltage expressed by the following equation from first power supply node 4*a*.

$$VCC/2+|VTP|-VTN$$

MOS transistor Q6 of output circuit OUT discharges the voltage level of output node 3 to the level expressed by the following equation of:

$$VCC/2-VTN+|VTP|$$

Therefore, voltage VO on output node 3 is expressed as:

$$VO=VCC/2+|VTP|-VTN$$

Since VTN is substantially equal to |VTP| in the structure shown in FIG. 6, voltage VO of output node 3 is approximately VCC/2.

According to the structure shown in FIG. 6, a voltage of two times the value of voltage VO (ground voltage as the reference) applied to output node 3 is supplied to third power supply node 5.

$$VCC+|VTP|-VCC-2|VTP|+2\cdot VTN=2\cdot VTN-|VTP|>0$$

In voltage generation unit VGA, two diode-connected MOS transistors are connected in series. Even when power supply voltage VCC is an extremely low value, the voltages of the third power supply node 5 and fourth power supply node 6 are shifted by respective threshold voltages, and MOS transistors Q7P and Q8N are both turned on similar to the voltage generation circuit of the fifth embodiment. Therefore, a voltage of a desired level can be generated reliably at nodes 1 and 2. Furthermore, MOS transistors Q5 and Q6 have respective source-voltages equal to the absolute value of the threshold voltage thereof in output circuit OUT. Therefore, they operate in a boundary region between an ON state and an OFF state, and in a push-pull manner, and almost no through current flows from power supply node 4*a* to ground node 4*b*. According to the voltage generation circuit of FIG. 6, a voltage of a desired level can be generated stably with low power consumption. Thus, a voltage generation circuit of a wide operating range of power supply voltage VCC can be obtained.

In the fifth and sixth embodiments, resistance elements R5 and R6 may be formed of a MOS transistor having a great channel resistance.

Seventh Embodiment

Figure 7:
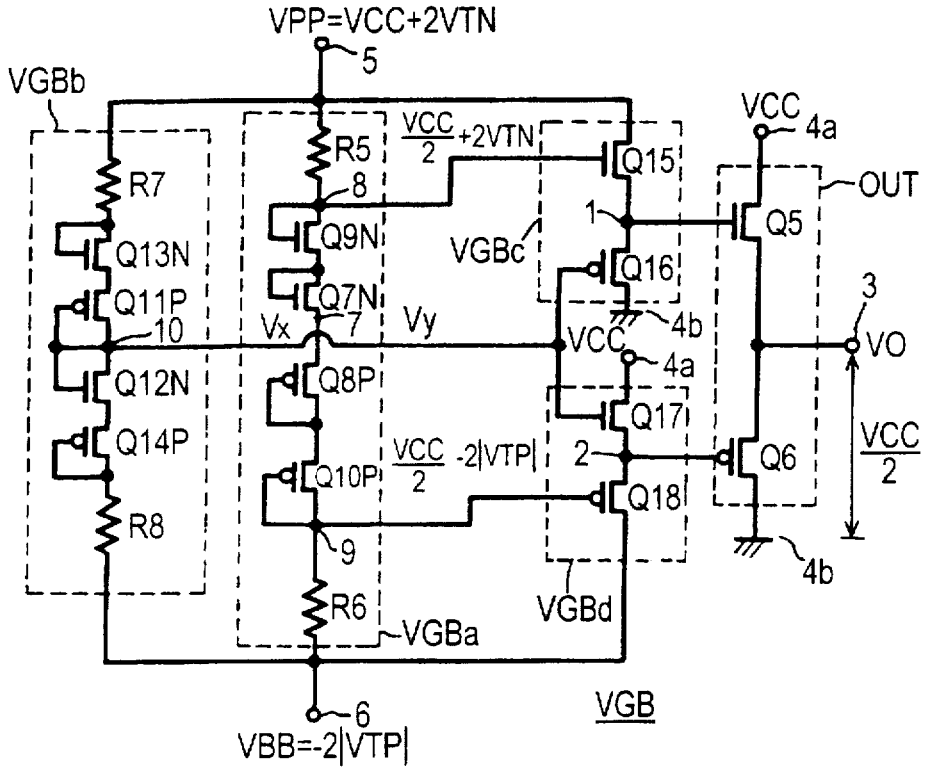

FIG. 7 shows a structure of a voltage generation circuit according to a seventh embodiment of the present invention. Referring to FIG. 7, the voltage generation circuit VGB includes a voltage generation section VGBa for generating third and fourth voltages onto nodes 8 and 9, respectively, from voltage VPP on third power supply node 5 and voltage VBB on fourth power supply node 6, a voltage generation section VGBb for generating a fifth voltage from voltage VPP on third power supply node 5 and voltage VBB on fourth power supply node 6 to supply the same onto a node 10, a voltage generation section VGBc receiving voltage VPP on third power supply node 5 and the voltage on ground node **4*b* for generating a first voltage applied to the gate of a MOS transistor Q5 in output circuit OUT according to third and fifth voltages from voltage generation sections VGBa and VGBb, and a voltage generation section VGBd connected between power supply node 4*a* and fourth power supply node 6 for generating a second voltage applied to the gate of a MOS transistor Q6 in output circuit OUT according to fourth and fifth voltages from voltage generation sections VGBa and VGBb. Output circuit OUT includes n channel MOS transistor Q5 and p channel MOS transistor 16**, similar to the preceding first to sixth embodiments.

Voltage generation section VGBa includes a resistance element R5 of high resistance connected between third power supply node 5 and node 8, diode-connected n channel MOS transistors Q9N and Q7N connected in series between nodes 8 and 7, diode-connected p channel MOS transistors Q8P and Q10P connected in series between nodes 7 and 9, and a resistance element R6 of high resistance connected between node 9 and fourth power supply node 6. The resistance values of resistance elements R5 and R6 are set to a value sufficiently greater than respective channel resistances of MOS transistors Q7N, Q8P, Q9N, and Q10P.

Voltage generation section VBGb includes a resistance element R7 of high resistance, an n channel MOS transistor Q13N, and a p channel MOS transistor Q11P connected in series between third power supply node 5 and node 10. Each of MOS transistors Q13N and Q11P are diode-connected, and causes a voltage drop equal to the absolute value of the threshold voltage from third power supply node 5 towards node 10.

Voltage generation section VGBb further includes an n channel MOS transistor Q12N, a p channel MOS transistor Q14P, and resistance element R9 of high resistance connected in series between node 10 and power supply node 6. Each of MOS transistors Q12N and Q14P are diode connected, and causes a voltage drop by the absolute value of the threshold voltage from node 10 towards fourth power supply node 6.

Voltage generation section VGBc includes an n channel MOS transistor Q15 connected between third power supply node 5 and node 1 for receiving a third voltage generated on node 8 from voltage generation section VGBa at its gate, and a p channel MOS transistor Q16 connected between node 1 and ground node **4*b*, and receiving a fifth voltage generated on node 10** of voltage generation section VGBb at its gate.

Voltage generation section VGBd includes an n channel MOS transistor Q17 connected between power supply node **4*a* and node 2, and having its gate connected to node 10 of voltage generation section VGBb, and a p channel MOS transistor Q18 connected between node 2 and fourth power supply node 6, and having a gate receiving a fourth voltage generated on node 9 from voltage generation section VGBa. Node 1 is connected to the gate of n channel MOS transistor Q5 in output circuit OUT. Node 2** is connected to the gate of p channel MOS transistor Q6 of output circuit OUT. The operation thereof will be described hereinafter.

Voltage VPP applied to third power supply node 5 is set to the level of VCC+2·VTN. Voltage VBB on fourth power supply node 6 is set to the level of −2|VTP|. The resistance values of resistance elements R5 and R6 each are set to a value sufficiently greater than the channel resistance of the MOS transistor in the corresponding path. MOS transistors Q7N, Q8P, Q9N and Q10P operate in a diode mode for causing a voltage drop of the absolute value of respective threshold voltages. Resistance elements R5 and R6 each have a resistance value equal to R. When a current I is conducted in voltage generation section VGBa, the voltage between node 7 and third power supply node 5 is expressed by the following equation:

$$VCC+2\cdot VTN-Vx=I\cdot R+VTN+|VTP|$$

where Vx refers to the voltage on node 7. The voltage between node 7 and fourth power supply node 6 is expressed as:

$$Vx+2|VTP|=2|VTP|+I\cdot R$$

Eliminating the term of I·R from the above equation, voltage Vx on node 7 is expressed as:

$$Vx=VCC/2$$

Therefore, voltage V8 on node 8 and voltage V9 on node 9 are expressed by the following equations:

$$V8=VCC/2+2\cdot VTN \quad (7)$$

$$V9=VCC/2-2|VTP| \quad (8)$$

In a voltage generation circuit or voltage generation section VGBb, the resistance values of resistance elements R7 and R8 each are set sufficiently greater than the channel resistance of the MOS transistor included in the associated path. Furthermore, with R the resistance values of resistance elements R7 and R8, I the current flowing through this path, and Vy the voltage on node 10, the following equation is obtained.

$$VCC+2\cdot VTN-Vy=I\cdot R+VTN+|VTP|$$

$$Vy+2|VTP|=VTN+|VTP|+I\cdot R$$

By eliminating the term of I·R from the above two equations, the following equation is obtained.

$$Vy=VCC/2+VTN-|VTP| \quad (9)$$

Since MOS transistor Q15 has a gate potential lower than the drain potential (the potential of third power supply node 5) in voltage generation section VGBc, MOS transistor Q15 operates in a source follower mode. Therefore, the voltage of node 1 is charged to the level of VCC/2+VTN by MOS transistor Q15. When the voltage of node 1 becomes greater than this charged level, the difference between voltage Vy expressed by equation (9) and voltage V1 on node 1 becomes greater than the absolute value of the threshold voltage of MOS transistor Q16, whereby MOS transistor Q16 is turned on to lower the potential of node 1. MOS transistor Q16 discharges voltage V1 of node 1 to the level of VCC/2+VTN. Therefore, voltage V1 of node 1 is expressed by the equation of:

$$V1=VCC/2+VTN$$

Similarly, MOS transistor Q17 operates in a source follower mode in voltage generation section VGBd to charge the potential level of node 2 to VCC/2|VTP|. When this voltage level is exceeded, MOS transistor Q18 is turned on, whereby the potential of node 2 is discharged to the level of VCC/2−|VTP|. Therefore, voltage V2 of node 2 is expressed by:

$$V2=VCC/2-|VTP|$$

In output circuit OUT, MOS transistors Q5 and Q6 operate in a source follower mode. Therefore, voltage VO on output node 3 attains the voltage level of VCC/2. In output circuit OUT, the gate-source voltages of MOS transistors Q5 and Q6 are respectively equal to the absolute values of respective threshold voltages, and operate in the boundary region between an ON state and an OFF state, to suppress power consumption to a sufficient low level. If the voltage on output node 3 is raised, MOS transistor Q6 is turned on. When voltage VO on output node 3 is lowered, MOS transistor Q5 is turned on. Therefore, voltage VO of VCC/2 level can be provided stably with low power consumption.

In voltage generation sections VGBc and VGBd, MOS transistors Q15–Q18 operate at the boundary region of an ON state and an OFF state. The power consumption thereof is extremely low in a stable state. Furthermore, since MOS transistors Q15 and Q16 carry out a push-pull operation in which one is turned off while the other is turned on, the voltage of MOS transistor Q5 can be maintained stably at a predetermined voltage level. MOS transistor Q17 and Q18 similarly carry out a push-pull operation to maintain the gate potential of MOS transistor Q16 stably at a predetermined level.

When voltage VO supplied from this voltage generation circuit is used as a bit line precharge voltage VBL or cell plate voltage VCP in a DRAM, a great parasitic capacitance is present in output node 3 due to bit line capacitance or cell plate capacitance. In order to charge this great parasitic capacitance at high speed and to maintain the predetermined voltage level thereof stably, the size of each of MOS transistors Q5 and Q6 (the channel width W, or ratio of channel width W to channel length L) is set to a great magnitude. Therefore, the gate capacitance of MOS transistors Q5 and Q6 becomes an extremely great value. When a gate having such a great capacitance is charged via a resistor having a great resistance value, increase of the gate potentials of MOS transistors Q5 and Q6 is slowed down in the rise of the potential thereof due to an RC delay of the resistor and the gate capacitance. More specifically, stabilization of the gate potentials of MOS transistors Q5 and Q6 to a predetermined level is time consuming when power is turned on, and the time period for a DRAM to attain an operable state after power-on is lengthened. There causes a problem that a DRAM cannot attain an operable state speedily after power is turned on.

This problem of delay in the rise of a potential can be solved by driving the gates of MOS transistors Q5 and Q6 of output circuit OUT by MOS transistors Q15–Q18 as shown in FIG. 7. More specifically, MOS transistors Q15–Q18 are required only for the purpose of driving the capacitance of the gates of MOS transistors Q5 and Q6. The gate capacitance of MOS transistors Q5 and Q6 are very small in comparison with to the bit line capacitance and the cell plate capacitance. Therefore, the size of MOS transistors Q15–Q18 (channel width, or ratio of channel width to channel length) can be set to approximately 1/10 to 1/100 that of MOS transistors Q5 and Q6. Therefore, the gate capacitance of MOS transistors Q15–Q18 are accordingly reduced. According to the structure where the gates of MOS transistors Q15–Q16 are charged via a resistance element of great resistance, the rising speed of the potential thereof can be speeded up 10 to 100 times that of the case where the gate potential of MOS transistors Q5 and Q6 is driven via a resistance element. As a result, the rise of voltage VO from output node 3 can be increased.

Therefore, voltage VO can be generated speedily and stably after power is turned on by using a voltage generation circuit of the structure shown in FIG. 7. In voltage generation sections VGBa and VGBb, the difference between the voltage of third power supply node 5 and fourth power supply node 6 can be set to the level of VCC+2·VTN+2|VTP|. The MOS transistors in each path can be reliably turned on even when power supply voltage VCC is low. Thus, the MOS transistor can operate in diode mode to generate a voltage of a required level even when a value of power supply voltage VCC is low.

According to the structure shown in FIG. 7, the position of MOS transistor Q13N and MOS transistor Q18P may be exchanged in voltage generation section VGBb. Furthermore, the position of MOS transistors Q12N and Q1OP can be interchanged.

Eighth Embodiment

Figure 8:
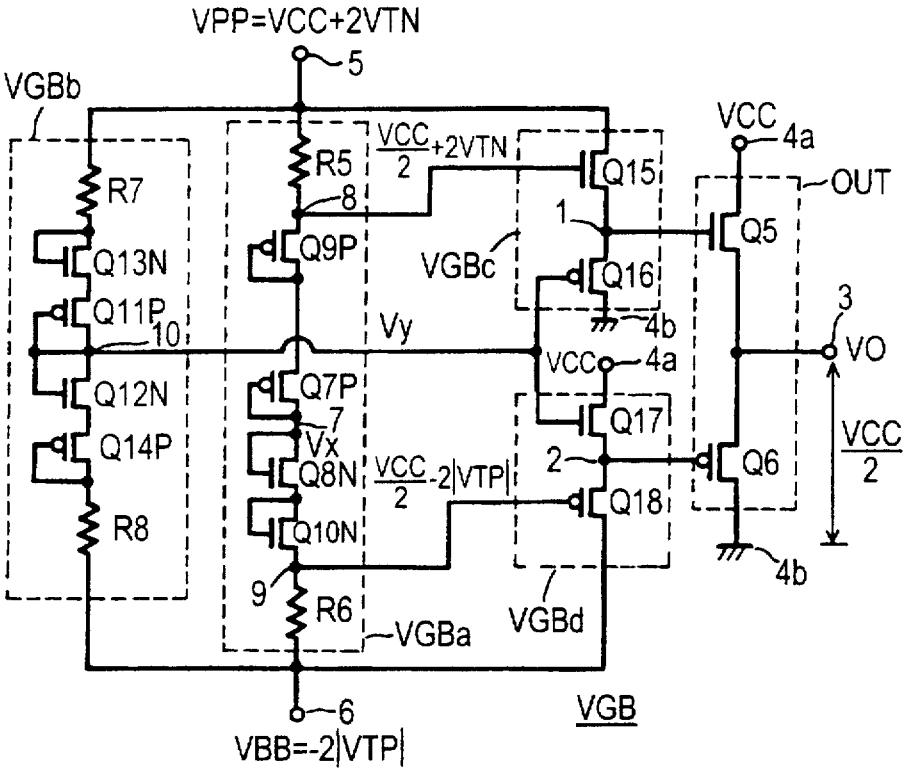

FIG. 8 shows a structure of a voltage generation circuit according to an eighth embodiment of the present invention. The structure of the voltage generation circuit of FIG. 8 is similar to the structure of the voltage generation circuit of FIG. 7 except for voltage generation section VGBa. Corresponding components have the same reference characters allotted.

In voltage generation section VGBa, diode-connected p channel MOS transistors Q9P and Q7P are connected in series between nodes 8 and 7. Furthermore, diode-connected n channel MOS transistors Q8N and Q10N are connected in series between nodes 7 and 9. The operation thereof will be described.

The resistance values of resistance elements R5 and R6 are set sufficiently higher than the channel resistance of MOS transistors Q9P, Q7P, Q8N and Q10N. Therefore, these MOS transistors each cause a voltage drop by the absolute value of the threshold voltage from third power supply node 5 to fourth power supply node 6. Assuming that the current flowing through voltage generation circuit VGBa is I, the following relationship is obtained.

$$VCC+2\cdot VTN-Vx=I\cdot R+2|VTP|$$

$$Vx+2|VTP|=2\cdot VTN+I\cdot R$$

By eliminating the term of I·R from the above two equations, the following equation is obtained.

$$Vx=VCC/2+2\cdot VTN-2|VTP|$$

Therefore, voltage V8 on node 8 and voltage V9 on node 9 are expressed by the following equations:

$$V8=VCC/2+2\cdot VTN$$

$$V9=VCC/2-2|VTP|$$

More specifically, voltages V8 and V9 on nodes 8 and 9 each attain a voltage level identical to each of the voltages on nodes 8 and 9 in the voltage generation circuit of FIG. 7. Therefore, advantages similar to those of the voltage generation circuit of the seventh embodiment can be achieved according to the circuit shown in FIG. 8.

Similar advantages can be achieved as long as two p channel MOS transistors and two n channel MOS transistors are connected in series to each other between nodes 8 and 9 and each is diode-connected. The order of arrangement of these MOS transistors is arbitrary.

Ninth Embodiment

Figure 9:
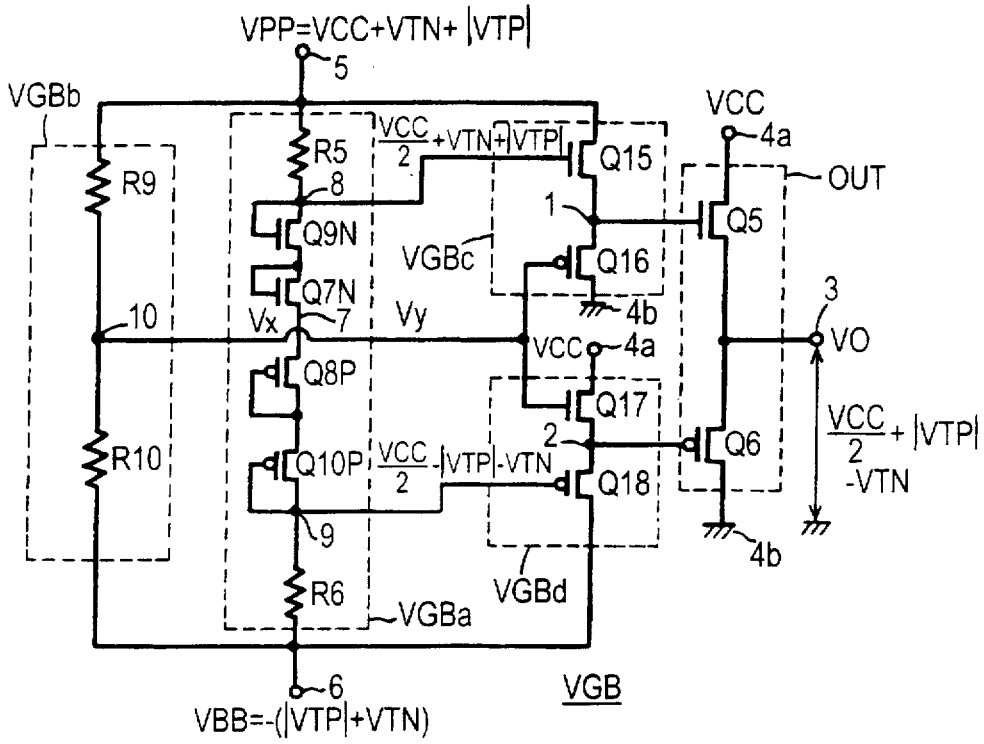

FIG. 9 shows a structure of a voltage generation circuit according to a ninth embodiment of the present invention. The voltage generation circuit of FIG. 9 is similar to that shown in FIG. 7 except for the structure of voltage generation section VGBb, and the levels of voltages VPP and VBB supplied to third power supply node 5 and fourth power supply node 6, respectively. Corresponding components have the same reference characters allotted.

Voltage generation section VGBb includes a resistance element R9 of high resistance connected between third power supply node 5 and node 10, and a high resistance element R10 of high resistance connected between node 10 and source power supply node 6. Resistance elements R9 and R10 have the same common resistance value. From the standpoint of lowering power consumption, resistance elements R9 and R10 have a high resistance value. Resistance elements R9 and R10 may be formed of a MOS transistor having a high channel resistance.

Voltage VPP applied to third power supply node 5 is set to the level of VCC+VTN+|VTP|. Voltage VBB applied to fourth power supply node 6 is set to the level of −(|VTP|+VTN). VTP designates an absolute value of a threshold voltage of the p channel MOS transistor in voltage generation section VGBa. VTN designates the threshold voltage of the MOS transistor in voltage generation section VGBa. The operation thereof will be described hereinafter.

Resistance elements R9 and R10 have the same reference value, and voltage Vy on node 10 is set to the voltage level of (VPP+VBB)/2=VCC/2. When the voltage on node 7 is Vx in voltage generation section VGBa, the following equation is obtained:

$$VCC+VTN+|VTP|-Vx=2\cdot VTN+I\cdot R$$

$$Vx+VTN+|VTP|=2|VTP|+I\cdot R$$

By eliminating the term of I·R from the above two equations, the following equation is obtained.

$$Vx=VCC/2+|VTP|-VTN$$

Therefore, voltage V8 on node 8 and voltage V9 on node 9 are represented by the following equations:

$$V8=Vx+2\cdot VTN=VCC/2+|VTP|+VTN$$

$$V9=Vx-2|VTP|=VCC/2-|VTP|-VTN$$

Therefore, a voltage V1 expressed by the following equations is supplied from node 1 of voltage generation section VGBc.

$$V1=VCC/2+|VTP|$$

Also voltage V2 expressed by the following equation is supplied from node 2 of voltage generation section VGBd.

$$V2=VCC/2-VTN$$

Therefore, voltage VO expressed by the following equation is supplied from output circuit OUT.

$$VO-VCC/2+|VTP|-VTN$$

Since VTN is substantially equal to |VTP|, voltage VO from output node 3 attains the voltage level of approximately VCC/2.

Since no MOS transistor is provided in voltage generation section VGBb according to the structure shown in FIG. 9, the number of elements can be reduced in contrast to the structure of the preceding seventh and eighth embodiments. According to the structure shown in FIG. 9, the difference between voltage VPP on third power supply node 5 and voltage VBB on fourth power supply node 6 can be expressed by the following equation:

$$VPP-VBB=VCC+2\cdot VTN+2|VTP|$$

Therefore, even when two n channel MOS transistors and two p channel MOS transistors are connected in series in this voltage generation section VGBa, these MOS transistors can be reliably turned on. Thus, a voltage of a desired voltage level can be generated reliably even in the case of a low power supply voltage VCC.

The drains of MOS transistors Q15 and Q18 are connected to third power supply node 5 and fourth power supply node 6, respectively, in order to operate MOS transistors Q15 and Q18 in a source follower mode. (This source follower mode will be described in detail afterwards).

According to the structure shown in FIG. 9, voltage VPP on third power supply node 5 satisfies the relationship of VPP>2−VO with respect to voltage VO on output node 3.

$$VPP-2\cdot VO=3\cdot VTN-|VTP|>0$$

According to the voltage generation circuit of the present ninth embodiment, a voltage generation circuit that can generate a voltage of a desired level stably over a wide range of a power supply voltage VCC with low power consumption can be obtained. Furthermore, voltage VO can be set to a predetermined level at high speed after power is turned on.

Tenth Embodiment

Figure 10:
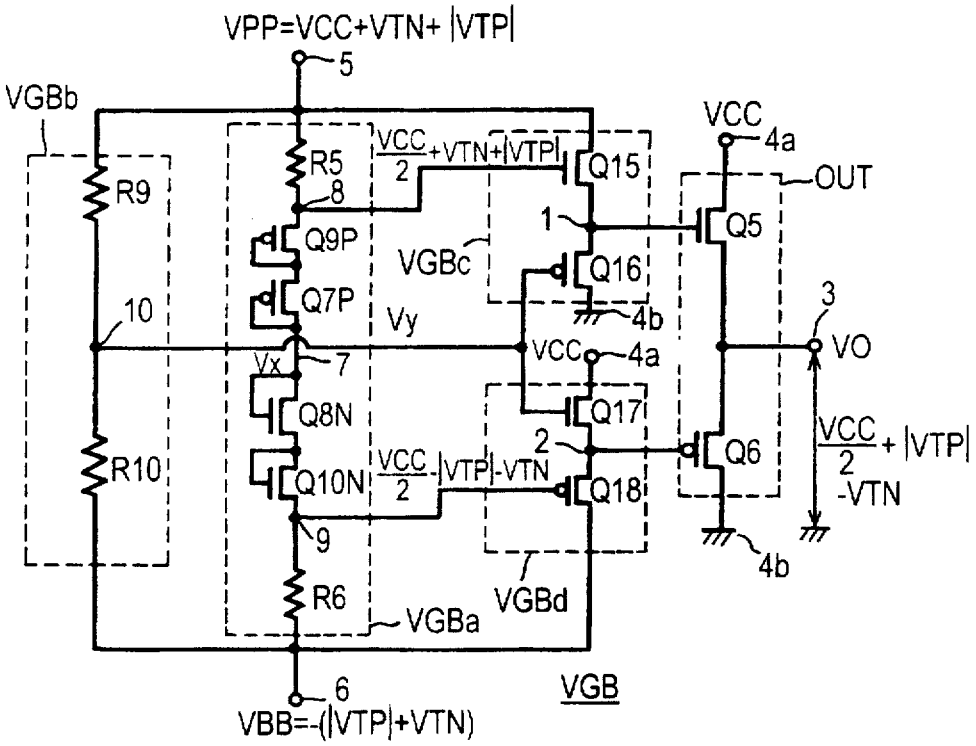

FIG. 10 shows a structure of a voltage generation circuit according to a tenth embodiment of the present invention. The voltage generation circuit of FIG. 10 has a structure similar to that shown in FIG. 9 except for the following points. Voltage generation section VGBa of the voltage generation circuit of FIG. 10 has diode-connected p channel MOS transistors Q9P and Q7P connected in series between nodes 8 and 7, and diode-connected n channel MOS transistors Q8N and Q10N connected in series between nodes 7 and 9.

The operation thereof will be described hereinafter. It is assumed that the resistance values of resistance elements R5 and R6 are R. Resistance value R is set sufficiently greater than the channel resistances of MOS transistors Q7P, Q8N, Q9P, and Q10N. Assuming that the current flowing through voltage generation section VGBa is I, the following relationship is obtained:

$$\begin{aligned} VPP-Vx &= VCC+VTN+|VTP|-Vx \\ &= I\cdot R-2|VTP| \end{aligned}$$

-continued $$Vx - VBB = Vx + |VTP| + VTN = 2|VTP| + I \cdot R$$

By eliminating term I·R from the above two equations, the following equation is obtained.

$$Vx = VCC/2 + VTN - |VTP|$$

Therefore, voltages V8 and V9 on node 8 and 9, respectively, are expressed by the following equations:

$$V8 = Vx + 2|VTP| = VCC/2 + VTN + |VTP|$$

$$V9 = Vx - 2|VTP| = VCC/2 - |VTP| - VTN$$

Voltages V8 and V9 on nodes 8 and 9 are identical to the voltages on nodes 8 and 9 in the voltage generation circuit of FIG. 9. Therefore, an operation identical to the voltage generation circuit of FIG. 9 is made according to the structure shown in FIG. 10 and similar advantages are achieved.

As for voltage generation section VGBa, similar advantages can be obtained as long as two diode-connected p channel MOS transistors and two diode-connected n channel MOS transistors are connected in series between nodes 8 and 9.

Eleventh Embodiment

Figure 11:
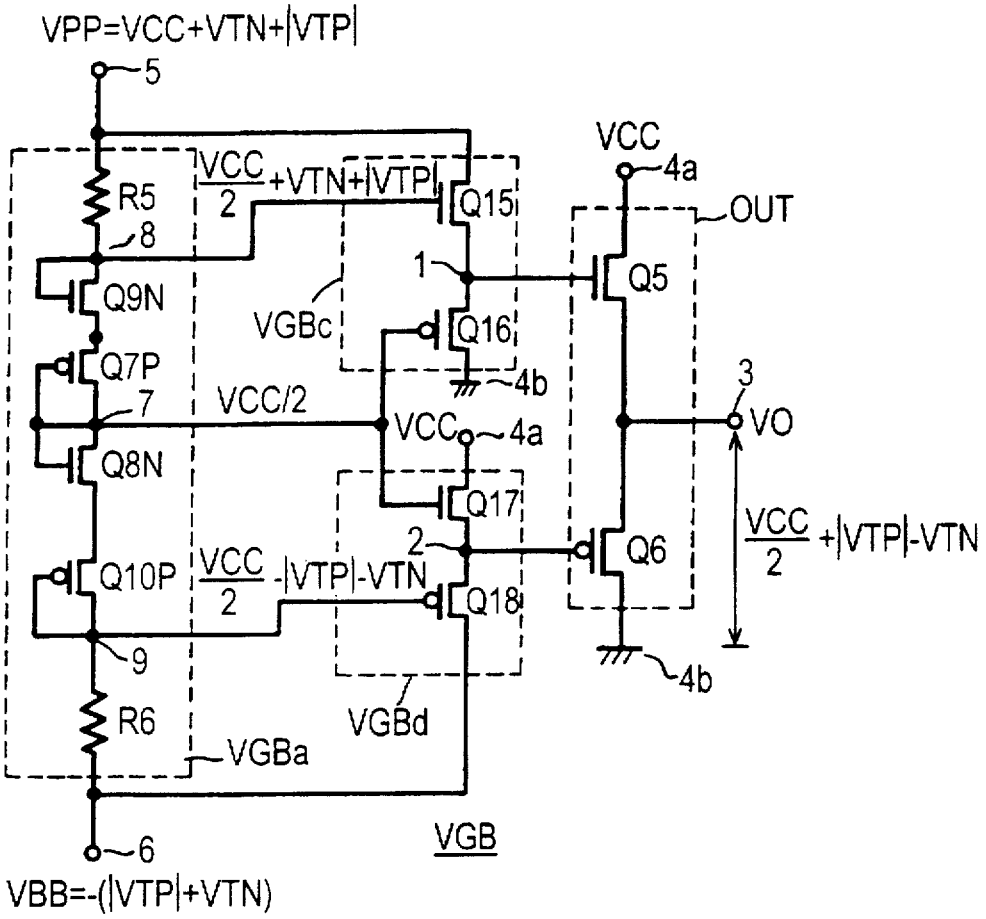

FIG. 11 shows a structure of a voltage generation circuit according to an eleventh embodiment of the present invention. The voltage generation circuit of FIG. 11 lacks voltage generation section VGBb for generating a fifth voltage Vy. Voltage generation section VGBa generates the fifth voltage. Voltage generation section VGBa includes a resistance element R5 of high resistance connected between third power supply node 5 and node 8, diode-connected n channel MOS transistor Q9N and p channel MOS transistor Q7P connected in series between nodes 8 and 7, diode-connected n channel MOS transistor Q8N and p channel MOS transistor Q10P connected in series between nodes 7 and 9, and a resistance element R6 of high resistance connected between node 9 and fourth power supply node 6.

Resistance elements R5 and R6 each have a resistance value sufficiently greater than the channel resistances of MOS transistors Q7P, Q8N, Q9N and Q10P. The structure of voltage generation sections VGBc and VGBd and output circuit OUT is similar to that of the voltage generation circuit of the previous seventh to tenth embodiments, and corresponding components have the same reference characters allotted. Voltage VPP applied to third power supply node 5 has a voltage level of VCC+VTN+|VTP|. Voltage VBB applied to fourth power supply node 6 has a voltage level of −(|VTP|+VTN). The operation thereof will be described hereinafter.

Resistance elements R5 and R6 both have a resistance value of R. It is assumed that the current flowing from third power supply node to fourth power supply node 6 in voltage generation section VGBa is I. Assuming that the voltage on node 7 is Vx, the following relationship is obtained.

$$VPP - Vx = VCC + VTN + |VTP| - Vx = I \cdot R + VTN + |VTP|$$

-continued $$Vx - VBB = Vx + |VTP| + VTN = VTN + |VTP| + I \cdot R$$

By eliminating term I·R from the above two equations, the following equation is obtained:

$$Vx = VCC/2$$

Therefore, voltages V8 and V9 on nodes 8 and 9, respectively, are expressed as:

$$V8 = VCC/2 + |VTP| + VTN,$$

$$V9 = VCC/2 - |VTP| - VTN.$$

MOS transistors Q15 and Q17 operate in a source follower mode. Voltages V1 and V2 from nodes 1 and 2, respectively, are expressed by the following equations.

$$V1 = VCC/2 + |VTP|$$

$$V2 = VCC/2 - VTN.$$

When voltage V1 on node 1 becomes higher than this voltage level, p channel MOS transistor Q16 is turned on, whereby the level of voltage V1 on node 1 is lowered. The voltage level down to which MOS transistor Q16 can discharge is VCC/2+|VTP|.

Similarly, when voltage V2 on node 2 is increased, MOS transistor Q18 is operated, whereby voltage V2 on node 2 is discharged to the level of VCC/2−VTN. Therefore, voltages V1 and V2 on nodes 1 and 2, respectively, are maintained at a voltage level represented by:

$$V1 = VCC/2 + |VTP|$$

$$V2 = VCC/2 - VTN$$

Since MOS transistors Q5 and Q6 operate in a source follower mode in output circuit OUT, voltage VO on output node 3 is represented by:

$$VO = VCC/2 + |VTP| - VTN$$

Since voltage generation sections VGBc and VGBd and output circuit OUT respectively operate in a push-pull manner in the circuit shown in FIG. 11, a voltage of the desired level can be generated stably with low power consumption.

The voltage difference between voltage VPP on third power supply node 5 and voltage VBB on fourth power supply node 6 is set to a value higher power supply voltage VCC than the sum of the absolute values of the threshold voltages of the MOS transistors in voltage generation sections VGBa. Therefore, all MOS transistors in voltage generation sections VGBa are reliably turned on even when power supply voltage VCC is low. Therefore, third to fifth voltages can be generated at predetermined voltage levels stably even under the condition of low power supply voltage.

It is not necessary to provide voltage generation section VGBb for generating a fifth voltage since voltage generation section VGBa also generates the fifth voltage. Therefore, the power consumption and occupying area with respect to voltage generation section VGBb can be eliminated to implement a voltage generation circuit of low power consumption and small occupying area.

In the structure shown in FIG. 11, the positions of MOS transistor Q9N and MOS transistor Q7P can be interchanged. Also, the positions of MOS transistors Q8N and Q10P can be interchanged.

Other Embodiments

Voltage VO supplied from voltage generation circuit VGB is described as having a voltage level approximately half the power supply voltage VCC. This is for the sake of convenience only, and the voltage value actually required in a DRAM is an intermediate value (VH+VL)/2 of voltages VH and VL corresponding to the state of storing "1" and "0", respectively, in the storage node of a memory cell capacitor, or the voltage of the bit line (voltage of a bit line during word line selection) when data is read out from a memory cell. Such circumstances will be described hereinafter.

Figure 12A:
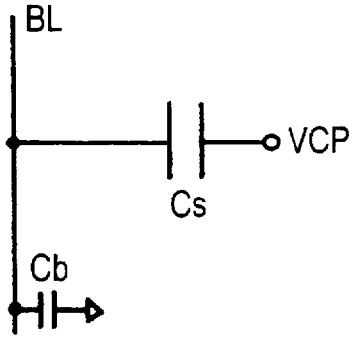
FIGS. 12A and 12B are diagrams for explaining the level of voltage generated by a voltage generation circuit.
Figure 12B:
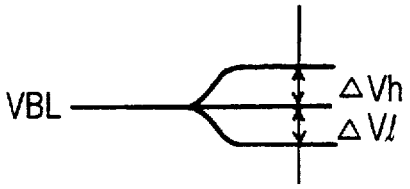

A state is considered in which a storage node of memory cell capacitor Cs is connected to bit line BL as shown in FIG. 12A. A cell plate voltage VCP is applied to the cell plate electrode of memory cell capacitor Cs. Parasitic capacitance Cb is present in bit line BL. It is considered that bit line BL is precharged to the level of voltage VBL. When voltage of "1" is stored in the storage node of memory cell capacitor Cs, the potential of bit line BL rises by ΔVh when the memory cell is selected as shown in FIG. 12B. When voltage of "0" is stored in the storage node of memory cell capacitor Cs, the potential of bit line BL is lowered from the level of precharge voltage VBL by ΔV1 as shown in FIG. 12B. These readout voltages ΔVh and ΔV1 are summarized as follows.

It is assumed that the voltages of the states storing "1" and "0" in memory cell capacitor Cs are VH and VL, respectively. The storage charges Q in the storage node of memory cell capacitor Cs in storing information "1" and "0" are represented by the following equations (10) and (11)

$$\text{"1"}: Q=Cs\cdot(VH-VCP) \tag{10}$$

$$\text{"0"}: Q=Cs\cdot(VL-VCP) \tag{11}$$

If the level of readout voltage ΔVh differs from the level of ΔV1, the margin of data "1" differs from that of data "0" with respect to the sense amplifier. Therefore, the operating margin of the sense amplifier is determined by the lower readout voltage to reduce the sense margin. In order to equalize the levels of ΔVh and ΔV1, the amount of storage charges Q shown in equations (10) and (11) must be equal to each other with opposite signs.

Namely, $Cs\cdot(VH-VCP)+Cs\cdot(VL-VCP)=0$

By modifying the above equation, equation (12) is obtained.

$$VCP=(VH+VL)/2 \tag{12}$$

More specifically, it is required that cell plate voltage VCP takes an intermediate value between voltage VH corresponding to a state of storing "1" and voltage VL corresponding to a state of storing "0".

Similarly in bit line BL, an intermediate value between voltages VH and VL must be taken. If bit line potential VBL is offset from an intermediate value between voltages VH and VL despite generation of readout voltages ΔVh and ΔV1 of the same level, the bit line potential in reading out data "1" differs from that in reading out data "0". Therefore, the sense margin is reduced. Thus, bit line precharge voltage VBL and cell plate voltage VCP are set to an intermediate value between voltage VH corresponding to the state storing of "1" and voltage VH corresponding to the state of storing "0" in the storage node of memory cell capacitor Cs. Voltage VO generated by voltage generation circuit VGB corresponds to the voltage level of the intermediate value between voltages VH and VL or the voltage level of bit line BL during word line selection, rather than being approximately a half of the power supply voltage.

Figure 13A:
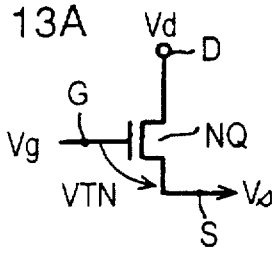
FIGS. 13A and 13B each are diagrams for explaining a source follower operation of an MOS transistor.
Figure 13B:
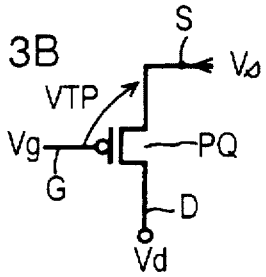

FIGS. 13A and 13B each are a diagram for explaining a source follower mode operation of an MOS transistor, wherein FIG. 13A indicates an n channel MOS transistor, and FIG. 13B indicates a p channel MOS transistor.

When an n channel MOS transistor NQ operates in a source follower mode as shown in FIG. 13A, the following relationship is established between voltage Vg of gate G and voltage Vs of source S.

$$Vs=Vg-VTN$$

Since an n channel MOS transistor NQ is required to operate in a saturation region, voltage Vd applied to drain D must satisfy the following relationship.

$$Vd\geqq Vg-VTN$$

Voltage Vd of drain D can take an arbitrary value as long as the above equation is satisfied. Therefore, the drain of MOS transistor Q5 for charging the output node in output circuit OUT does not have to be coupled to power supply node 4a to receive power supply voltage VCC. A voltage within the range of VCC±ΔVCC is required (for operation in a saturation region). For example, in a DRAM that down-converts external power supply voltage EXTVCC internally to generate an internal power supply voltage INTVCC, the drain of MOS transistor Q5 may be set to receive external power supply voltage EXTVCC. In this case, voltage generation section VGB generates a voltage with internal operating power supply voltage INTVCC as a reference. This drain voltage applies also to MOS transistors Q15 and Q17 in voltage generation sections VGBc and VGBd that operate in a source follower mode.

When p channel MOS transistor PQ operates in a source follower mode as shown in FIG. 13B, a relationship similar to n channel MOS transistor NQ is established between voltage Vg of gate G and voltage Vs of source S.

$$Vs=Vg-VTP=Vg+|VTP|$$

Since operation in a saturation region is required, voltage Vd of drain D and gate voltage Vg in the p channel MOS transistor meets the following relationship.

$$Vd\leqq Vg-VTP=Vg+|VTP|$$

Here, VTP is the threshold voltage of p channel MOS transistor PQ, and has a negative value. Threshold voltage VTN of n channel MOS transistor NQ has a positive value.

Drain voltage Vd may take an arbitrary value in p channel MOS transistor PQ as long as operation in a saturation region is ensured. Therefore, it is not necessary to provide to the drain of MOS transistor Q6 in output circuit OUT the level of ground voltage VSS, and may be adapted to receive a voltage in the range of 0±ΔVSS as long as operation in a saturation region is guaranteed. This also applies for the drain voltages of MOS transistors Q16 and Q18 in voltage generation sections VGBc and VGBd.

More specifically, source voltage Vs of a MOS transistor operating in a source follower mode is determined only by the value of gate voltage Vg and threshold voltage VTN or VTP, and is not dependent upon the value of drain voltage Vd (as long as operation in a saturation region is guaranteed). Therefore, ground node 4b may be adapted to receive the voltage on fourth power supply node 6 in the previous embodiments.

[Circuit 1 Generating Voltage Applied to Third Power Supply Node]

Figure 14A:
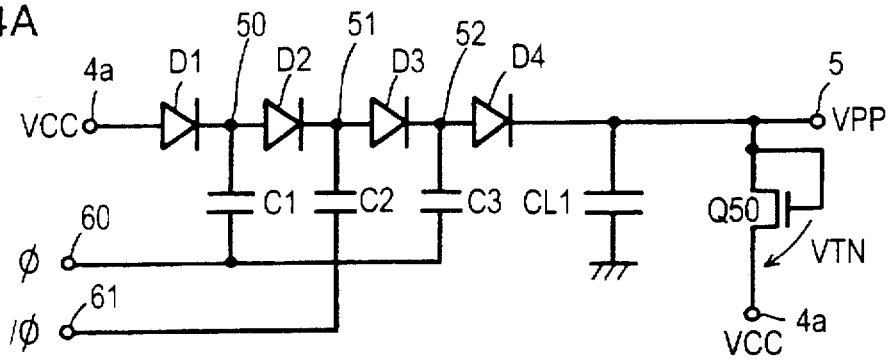
FIG. 14A shows a structure of a circuit for generating a voltage VPP applied to a third power supply node.
Figure 14B:
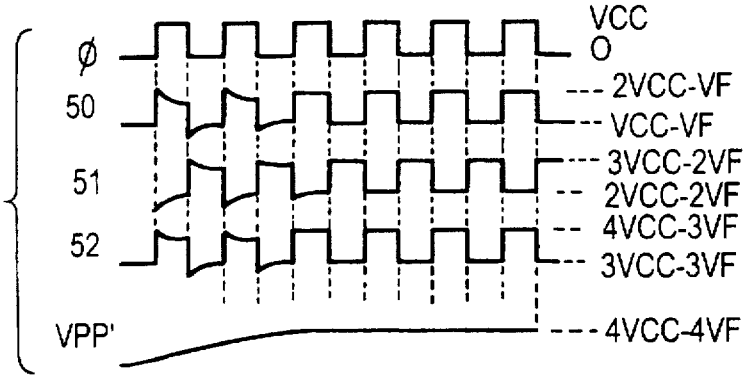
FIG. 14B shows an operation waveform thereof.

FIG. 14A shows a structure for generating voltage VPP applied to a third power supply node, and FIG. 14B shows an operation waveform thereof. A VPP generation circuit includes diode elements D1–D4 connected in series between power supply node 4a and third power supply node 5, a stabilization capacitor CL1 for stabilizing the voltage of third power supply node 5, and an n channel MOS transistor Q50 connected between third power supply node 5 and power supply node 4a, and operating in a diode mode. Diode elements D1 and D4 are arranged in a forward direction from power supply node 4a towards third power supply node 5.

VPP generation circuit further includes a boosted capacitor C1 connected between a clock signal input node 60 and a node 50 between diode elements D1 and D2, a booster capacitor C2 connected between a clock signal input node 61 and a node 51 between diode elements D2 and D3, and a booster capacitor C3 connected between clock signal input node 60 and a node 52 between diode elements D3 and D4. Complementary clock signals $\phi$ and $/\phi$ are applied to clock signal input nodes 60 and 61, respectively. Clock signals $\phi$ and $/\phi$ oscillate between OV and power supply voltage VCC. The operation thereof will be described hereinafter with reference to FIG. 14B.

When clock signal $\phi$ attains a high level and clock signal $/\phi$ attains a low level, the potentials of nodes 50 and 52 are boosted by the charge pumping operation of booster capacitors C1 and C3. The potential of node 51 is lowered according to the charge pumping operation of booster capacitor C2. Diode element Dl receives power supply voltage VCC from power supply node 4a, to precharge the potential of node 50 to the potential level of VCC–VF. Here, VF is a forward voltage drop of each of diode elements D1–D4. Therefore, when clock signal $\phi$ is driven to a high level, the potential of node 5 is pulled up to the level of 2·VCC–VF by the charge pumping operation of booster capacitor C1. The charge of node 50 is transferred to node 51 via diode element D2 to boost the potential of node 51. When the difference between the potential of node 50 and node 51 becomes VF, diode element D2 attains an OFF state. Here diode element D3 attains an OFF state. When the potential of node 52 is increased, charge is supplied towards stabilization capacitor CL1 via diode element D4, whereby the potential of node 5 is increased.

When clock signal $\phi$ is driven to a low level and clock signal $/\phi$ is driven to a high level, the potentials of nodes 50 and 52 fall, and the potential of node 51 rises. Under this state, diode element D3 is turned ON, whereby charge is injected from node 51 towards node 52 to increase the potential of node 52. By repeating this operation, the potential of node 50 makes a transition between VCC–VF and 2·VCC–VF in a stable state. Since node 51 is precharged from node 50 via diode element D2, the potential thereof makes a transition between 2·VCC–2·VF and 3·VCC–2·VF. Since node 52 is precharged from node 51 via diode element D3, the potential makes a transition between 3·VCC–3·VF and 4·VCC–3·VF. Therefore, a voltage of 4 (VCC–VF) is generated as the maximum generation voltage VPP' from diode element D4. MOS transistor Q50 is connected between third power supply node 5 and power supply node 4a to maintain the difference of voltage VPP on third power supply node 5 and power supply voltage VCC on power supply node 4a to the level of the threshold voltage VTN thereof. Therefore, voltage VPP supplied to third power supply node 5 is:

$$VPP=VCC+VTN$$

When this n channel MOS transistor Q50 is used as a clamp transistor to generate voltage VPP higher than power supply voltage VCC, voltage VPP' generated by a charge pump circuit formed of diode elements D1–D4 and booster capacitors C1–C3 must be higher than voltage VPP.

Figure 15:
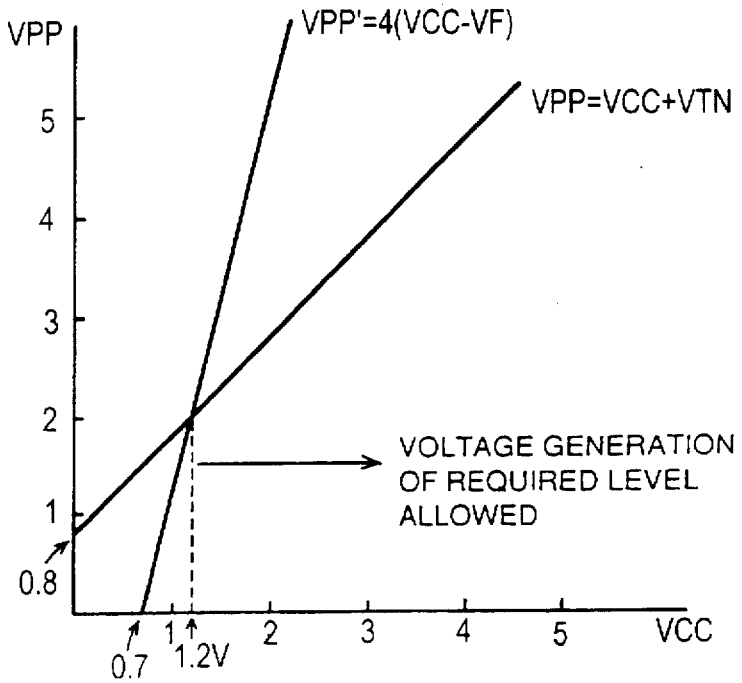
FIG. 15 is a diagram for obtaining the level of the power supply voltage required for clamping voltage VPP.

FIG. 15 shows the relationship between power supply voltage VCC and voltages VPP and VPP'. Power supply voltage VCC is plotted along the abscissa, and voltages VPP and VPP' are plotted along the ordinates. In order to generate voltage VPP of a required level by a clamping operation of MOS transistor Q50, VPP≦VPP' must be satisfied. Namely, $$VPP' \geqq VPP=VCC+VTN.$$

More specifically, the relationship of:

$$4(VCC-VF) \geqq VCC+VTN.$$

$$VCC \geqq (4VF+VTN)/3$$

must be satisfied. Assuming that the forward voltage drop VF of each of diode elements D1–D4 is 0.7V, and the threshold voltage VTN of n channel MOS transistor Q50 is 0.8V, the following equation is established.

$$VCC \geqq (2.8+0.8)/3=1.2V$$

More specifically, voltage VPP of a required level can be generated if power supply voltage VCC is greater than 1.2V. This means that power supply voltage VCC can be reduced to the level of 1.2V.

[VPP Generation Circuit 2]

Figure 16:
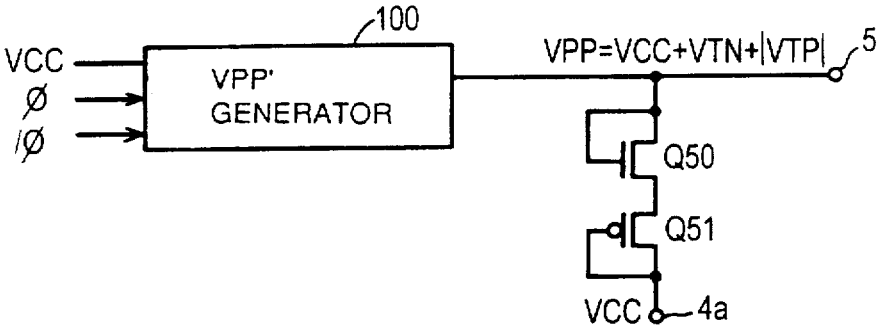
FIG. 16 shows another structure of a VPP generation circuit.

FIG. 16 shows another structure of a VPP generation circuit. Referring to FIG. 16, the VPP generation circuit includes a VPP' generator 100 for generating a voltage VPP' according to power supply voltage VCC and clock signals $\phi$ and $/\phi$, and an n channel MOS transistor Q50 and a p channel MOS transistor Q51 connected in series between third power supply node 5 and power supply node 4a. MOS transistors Q50 and Q51 are respectively diode-connected. VPP' generator 100 includes diode elements D1–D4, booster capacitors C1–C3, and stabilization capacitor CL1 shown in FIG. 14A. According to the structure shown in FIG. 16, the level of voltage VPP of third power supply node 5 is expressed by the following equation of:

$$VPP=VCC+VTN+|VTP|$$

Here, VTN and VTP show the threshold voltages of MOS transistors Q50 and Q51, respectively.

[VPP Generation Circuit 3]

Figure 17:
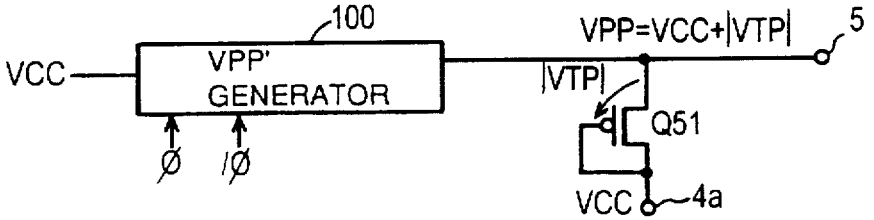
FIG. 17 shows still another structure of a VPP generation circuit.

FIG. 17 shows yet another structure of a VPP generation circuit. Referring to FIG. 17, the VPP generation circuit includes a VPP' generator 100, and a p channel MOS transistor Q51 connected between third power supply node 5 and power supply node 4a. MOS transistor Q51 has its gate and drain connected to third power supply node 4a and its source connected to power supply node 5. MOS transistor Q51 is turned on when voltage VPP on third power supply node 5 is higher than VCC+|VTP| to reduce the level of voltage VPP. According to the clamping function of MOS transistor Q51, voltage VPP of a level expressed by the following equation is supplied from third power supply node 5.

$$VPP=VCC+|VTP|$$

Here, VTP refers to the threshold voltage of MOS transistor Q51.

In order to generate a voltage of VPP=VCC+2VTN, two diode-connected n channel MOS transistors connected in series may be employed.

[VBB Generation Circuit 1]

Figure 18:
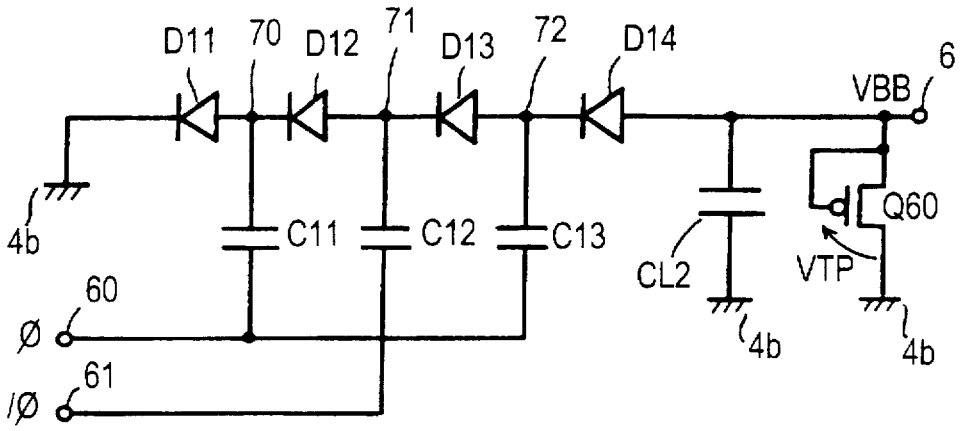
FIG. 18 shows a structure of a circuit for generating voltage VBB applied to a fourth power supply node.

FIG. 18 shows a further structure of a circuit for generating voltage VBB applied to a fourth power supply node. Referring to FIG. 18, the VBB generation circuit includes diode elements D11–D14 connected in series between fourth power supply node 6 and ground node 4b, a charge pump capacitor C11 connected between a node of diode elements D11 and D12 and clock signal input node 60, a charge pump capacitor C12 connected between a node 71 of diode elements D12 and D13 and clock signal input node 61, and a charge pump capacitor C13 connected between a node 71 of diode capacitors D13 and D14 and clock signal input node 60. Diode elements D11–D14 are connected in a forward direction from fourth power supply node 6 towards ground node 4b. Complementary clock signals ϕ and /ϕ are supplied to clock signal input nodes 60 and 61, respectively.

Figure 19:
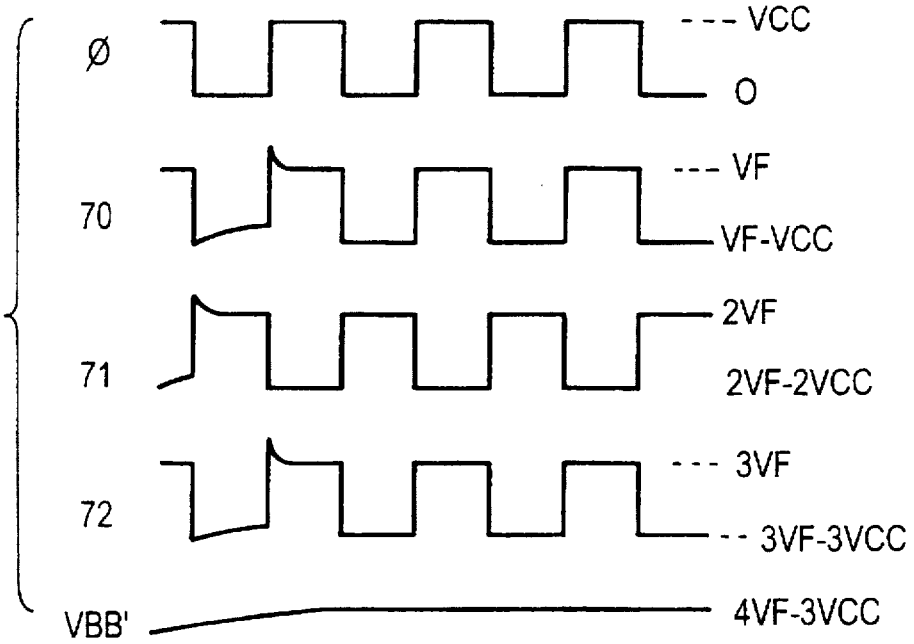
FIG. 19 is a waveform diagram showing an operation of the VBB generation circuit of FIG. 18.

The VBB generation circuit further includes a stabilization capacitor CL2 connected between fourth power supply node 6 and ground node 4b, and a p channel MOS transistor Q60 connected between fourth power supply node 6 and ground node 4b. MOS transistor Q60 has its gate and drain connected to fourth power supply node 6. MOS transistor Q60 has a threshold voltage VTP. Diode elements D11–D14 each have a forward voltage drop VF. The operation thereof will be described hereinafter with reference to FIG. 19.

Clock signals ϕ and /ϕ makes a transition between ground voltage 0V and power supply potential VCC. When clock signal ϕ applied to clock signal input node 60 is pulled up to a high level, clock signal /ϕ applied to clock signal input node 61 is pulled down to a low level. Although the potential of node 70 rises in response to a rise of clock signal ϕ by charge pump capacitor C11, the potential is discharged to the level of VF by diode element D11. In response to a fall of clock signal ϕ, the potential of node 71 is lowered by charge pump capacitor C12, and diode element D12 is turned off. Diode element D13 is rendered conductive due to the rise of the potential of node 72 by a charge pump operation of charge pump capacitor C13 in response to a rise of clock signal ϕ. Charge moves from node 72 to node 71 via diode element D13. When the potential of node 71 becomes lower than the potential of node 72 by forward voltage drop VF, diode element D13 is turned off. Since the potential of node 72 is higher than the anode potential of diode element D14, diode element D14 is turned off.

When clock signal ϕ is pulled down to a low level and clock signal /ϕ is pulled up to a high level, the potentials of nodes 70 and 72 become lower by charge pump capacitors C11 and C13. The potential of node 71 is pulled up by charge pump capacitor C12. In this state, diode element D12 conducts, whereby charge moves from node 71 towards node 70 to reduce the potential of node 71. Since the potential of node 72 is lower than the potential of node 71, diode element D13 attains an OFF state. Reduction in the potential of node 72 causes charge to flow thereto via diode element D14 to reduce the anode potential of diode element D14. When the potential difference between the anode and cathode of diode element D14 becomes VF, diode element D14 is turned off.

In a stable state, the potential of node 70 changes between VF and VF–VCC. Node 71 is discharged to the level of 2·VF–VCC since the potential of node 70 attains the level of VF–VCC when diode element D12 conducts. Therefore, the potential of node 71 changes between 2·VF–VCC and 2·VF–2·VCC. Node 72 is discharged to the level of 3·VF–2·VCC since diode element D13 conducts and the potential of node 71 attains the level of 2·VF–2·VCC during the rise of the potential thereof. Therefore, the potential of node 72 makes a transition between 3·VF–2·VCC and 3·VF–3·VCC. Thus, the minimum potential VBB' that can be reached and is applied by diode element D14 is expressed by the following equation.

$$VBB'=3\cdot VF-3\cdot VCC+VF=4\cdot VF-3\cdot VCC$$

It is to be noted that a p channel MOS transistor Q60 is provided between fourth power supply node 6 and ground node 4b. MOS transistor Q60 is turned on when the voltage on fourth power supply node 6 becomes lower than VTP, i.e. |VTP|, to supply the current from ground node 4b to fourth power supply node 6 to increase the potential thereof. Therefore, the voltage level of VBB provided from fourth power supply node 6 is expressed by the following equation:

$$VBB=-|VTP|$$

The provision of stabilization capacitor CL2 allows negative charge or positive charge to be supplied therefrom even when noise is generated to maintain voltage VBB at a predetermined level stably.

The following relationship must be satisfied for MOS transistor Q60 to implement a clamp function.

$$VBB'\leqq VBB$$

Figure 20:
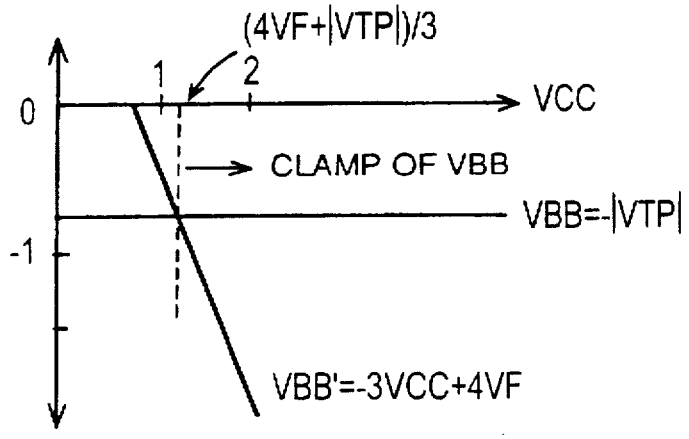
FIG. 20 is a diagram for obtaining a power supply voltage level for implementing the clamping function of the VBB generation circuit of FIG. 18.

FIG. 20 shows the relationship between voltages VBB and VBB'. Clamping of voltage VBB is effected in a region of power supply voltage higher than the crossing point between voltage VBB and voltage VBB' in FIG. 20. This clamp region is obtained by the following equation from FIG. 20.

$$-3(VCC-VF)+VF\leqq-|VTP|$$

$$VCC\geqq(4\cdot VF+|VTP|)/3$$

Assuming that $$VF=0.7V,\ |VTP|=0.85V,$$

$$VCC\geqq(2.8+0.85)/3=1.2V$$

From the above equation, a clamp operation is effected by MOS transistor Q60 when power supply voltage VCC is in a range above 1.2V to allow generation of voltage VBB of −|VTP| level. This means that power supply voltage VCC can be lowered to the level of 1.2V by the use of the charge pump circuit shown in FIG. 18.

[VBB Generation Circuit 2]

Figure 21:
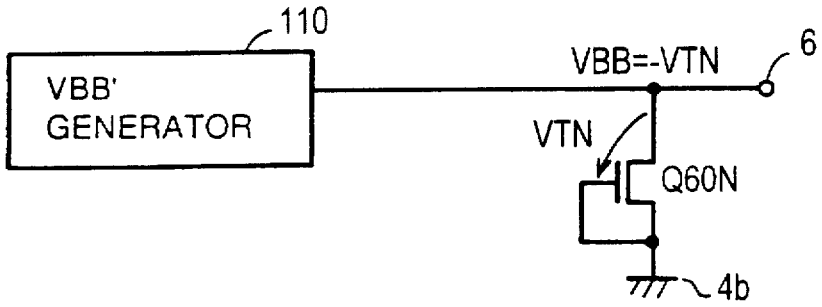
FIG. 21 shows another structure of a VBB generation circuit.

FIG. 21 shows another structure of a VBB generation circuit. Referring to FIG. 21, the VBB generation circuit includes a VBB' generator 110 for generating a voltage VBB', and an n channel MOS transistor Q60N connected between fourth power supply node 6 and ground node 4b. MOS transistor Q60N has its gate and drain connected to ground node 4b and its source connected to fourth power supply node 6. MOS transistor Q60N conducts when voltage VBB on fourth power supply node 6 becomes lower than −VTN, whereby current is supplied from ground node 4b towards power supply node 6 to increase the level of voltage VBB. Therefore, MOS transistor Q60N clamps voltage VBB to the level of −VTN.

VBB' generator 110 includes diode elements D11–D14, charge pump capacitors C11–C13, and stabilization capacitor CL2 shown in FIG. 18. Negative voltage VBB' generated by a charge pumping operation from VBB' generator 110 is clamped by MOS transistor Q60N to generate voltage VBB of a predetermined voltage level of −VTN.

[VBB Generation Circuit 3]

Figure 22:
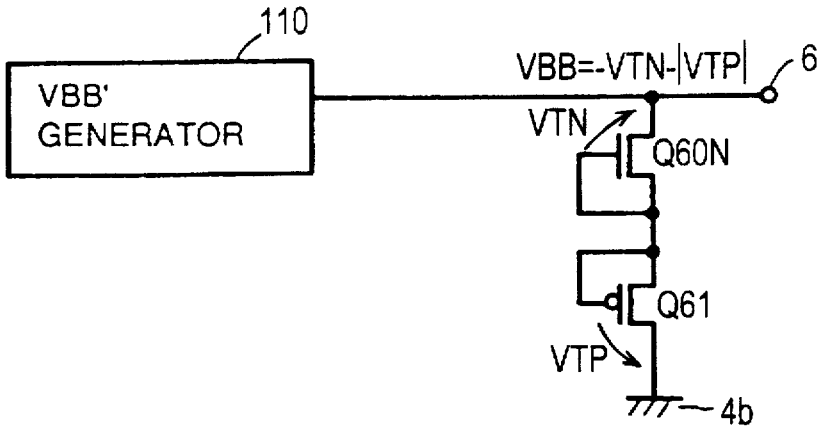
FIG. 22 shows a further structure of a VBB generation circuit.
Figure 23:
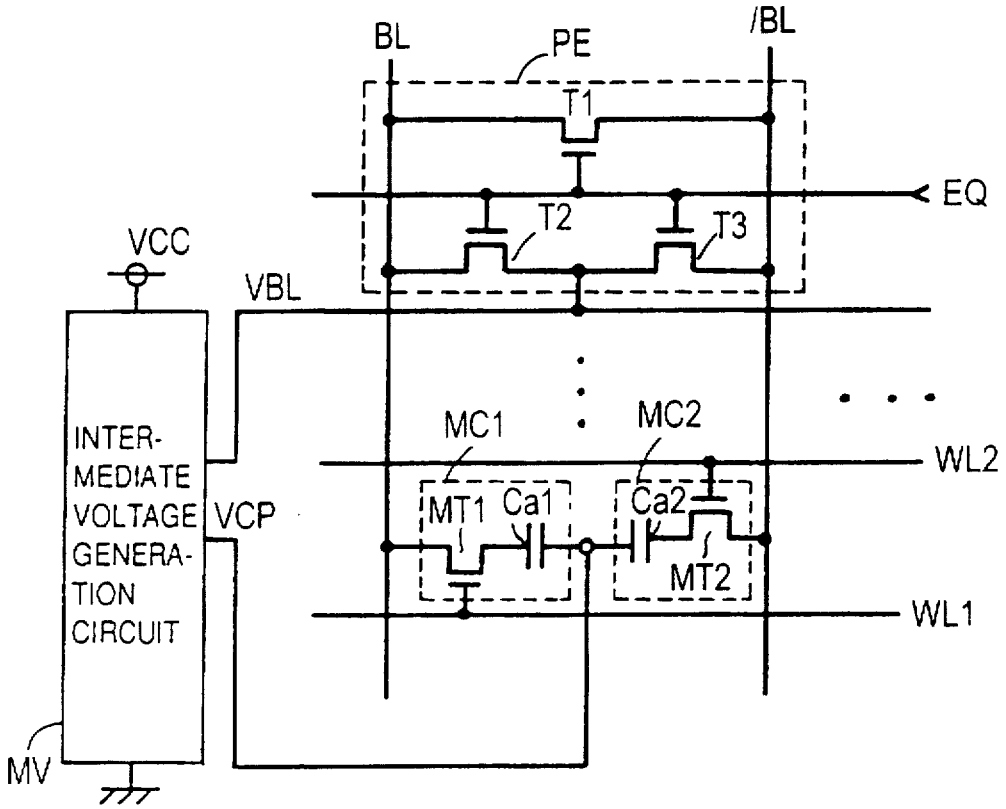
FIG. 23 PRIOR ART
FIG. 23 shows a structure of the main part of a DRAM to which the present invention is applied.
Figure 24:
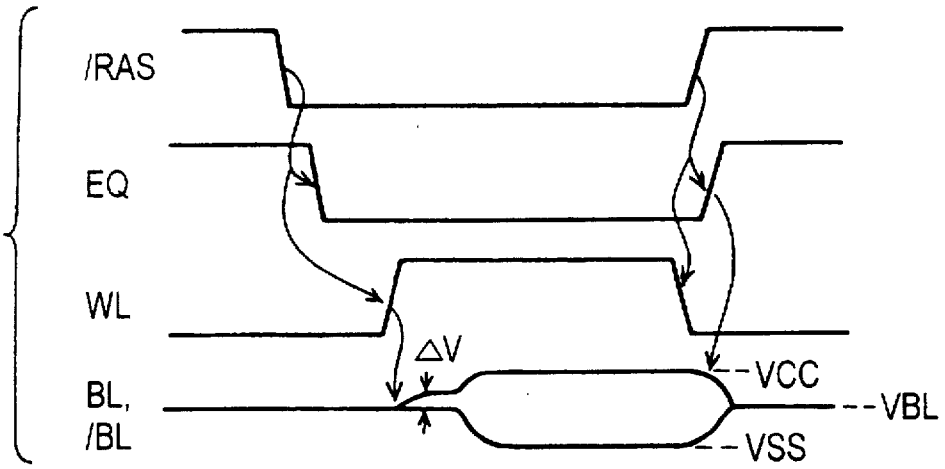
FIG. 24 PRIOR ART
FIG. 24 is a waveform diagram showing an operation of the DRAM shown in FIG. 22.

FIG. 22 shows yet another structure of a VBB generation circuit. The VBB generation circuit shown in FIG. 22 has an n channel MOS transistor Q60N and a p channel MOS transistor Q61 connected in series between fourth power supply node 6 and ground node 4b. MOS transistors Q60N and Q61 are diode-connected so as to operate in a diode mode in a forward direction from ground node 4b towards fourth power supply node 6.

VBB' generation unit 110 includes diode elements D11–D14, charge pump capacitors C11–C13, and stabilization capacitor CL2 shown in FIG. 18. The voltage generated by the charge pumping operation from VBB generation unit 110 is clamped by MOS transistors Q60N and Q61. MOS transistors Q60N and Q61 are turned on when a voltage difference of VTN and |VTP|, respectively, are generated between respective gate and source. Therefore, voltage VBB generated from source power supply node 6 has a level expressed by the following equation.

$$VBB=-VTN-|VTP|$$

It is to be noted that the positions of MOS transistors Q60N and Q61 can be interchanged in FIG. 22.

A structure in which two diode-connected p channel MOS transistors are connected in series may be employed, in order to generate a voltage of VBB=−2|VTP|.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A voltage generation circuit for generating a voltage of a predetermined level to an output node, comprising:

a first insulating gate type field effect transistor of a first conductivity type having one electrode node coupled to a first power supply node and another electrode node coupled to said output node, a second insulated gate type field effect transistor of a second conductivity type having one electrode node coupled to a second power supply node and another electrode node coupled to said output node, and voltage generation means receiving voltages on at least third and fourth power supply nodes for generating first and second voltages according to the received voltages for supply to control electrode nodes of said first and second insulated gate type field effect transistors, wherein a difference between said first and second voltages is equal to a sum of an absolute value of a threshold voltage of said first insulated gate field effect transistor and an absolute value of a threshold voltage of said second insulated gate field effect transistor, wherein the voltage of said third power supply node assumes a voltage level higher than two times a difference between a voltage supplied from said output node and a reference voltage applied to said second power supply node, and wherein the voltage of said fourth power supply node assumes a voltage level lower than said reference voltage.

2. The voltage generation circuit according to claim 1, wherein said voltage generation means comprises a first voltage generation section coupled between said third power supply node and a fifth power supply node to which a voltage lower than the voltage on said third power supply node is applied, for generating said first voltage from the voltages on said third and fifth power supply nodes, and a second voltage generation section connected between said fourth power supply node and a sixth power supply node to which a voltage higher than the voltage on said fourth power supply node is applied, for generating said second voltage from the voltages on said fourth and sixth power supply node.

3. The voltage generation circuit according to claim 2, wherein said first voltage generation section comprises first voltage divider means connected between said third power supply node and a first internal node, for dividing the voltage on said third power supply node and a voltage on said first internal node for generating said first voltage, and a third insulated gate field effect transistor connected between said first internal node and said fifth power supply node, and operating in a diode mode, wherein the voltage of said third power supply node is substantially equal to a sum of a voltage of two times the difference between the voltage from said output node and said reference voltage and an absolute value of a threshold voltage of said third insulated gate field effect transistor, and wherein the voltage on said fifth power supply node is a voltage of said reference voltage level.

4. The voltage generation circuit according to claim 2, wherein said second voltage generation section comprises a fourth insulated gate field effect transistor connected between said sixth power supply node and a second internal node, and operating in a diode mode, and second voltage divider means connected between said second internal node and said fourth power supply node for dividing a voltage on said second internal node and the voltage on said fourth power supply node to generate said second voltage, wherein the voltage of said sixth power supply node is a voltage of two times a difference between the voltage from said output node and said reference voltage, and the voltage on said fourth power supply node is a voltage lower than said reference voltage by an absolute value of a threshold voltage of said fourth insulated gate field effect transistor.

5. The voltage generation circuit according to claim 1, wherein said voltage generation means comprises first voltage divider means connected between said third power supply node and a first internal node for dividing the voltage on said third power supply node and a voltage on said first internal node to generate said first voltage, a third insulated gate field effect transistor connected between a fifth power supply node to which said reference voltage is applied and said first internal node, and operating in a diode mode, second voltage divider means connected between said fourth power supply node and a second internal node for dividing the voltage on said fourth power supply node and a voltage on said second internal nodes to generate said second voltage, and a fourth insulated gate field effect transistor connected between said second internal node and a sixth power supply node to which a voltage of a level substantially equal to a sum of said first and second voltages is applied, and operating in a diode mode, wherein the difference between the voltage on said third power supply node and the voltage on said sixth power supply node is substantially equal to an absolute value of a threshold voltage of one of said third and fourth insulated gate field effect transistors, and the voltage on said fourth power supply node is of a level lower than said reference voltage by an absolute value of a threshold voltage of the other of said third and fourth insulated gate field effect transistors.

6. The voltage generation circuit according to claim 1, wherein said voltage generation means comprises a first voltage generation section formed of a first resistance element and a diode-connected third insulated gate field effect transistor connected in series between said third power supply node and a first internal node for generating said first voltage from a connection of said first resistance element and said third insulated gate field effect transistor, and a second voltage generation section formed of a second resistance element and a fourth insulated gate field effect transistor connected in series between said first internal node and said fourth power supply node for generating said second voltage from a connection of said second resistance element and said fourth insulated gate field effect transistor.

7. The voltage generation circuit according to claim 6, wherein the voltage on said third power supply node is higher than two times a difference between the voltage supplied from said output node and said reference voltage, and a sum of the voltages on said third and fourth power supply nodes is equal to a sum of said first and second voltage, and the voltage on said fourth power supply node is substantially equal to a voltage level lower than said reference voltage by an absolute value of a threshold voltage of said fourth insulated gate field effect transistor.

8. The voltage generation circuit according to claim 7, wherein one of said third and fourth insulated gate field effect transistors is of said first conductivity type, and the other of said third and fourth insulated gate field effect transistor is of said second conductivity type.

9. The voltage generation circuit according to claim 1, wherein said voltage generation means comprises a voltage generation section connected between said third power supply node and said fourth power supply node for generating third, fourth, and fifth voltages from the voltage on said third power supply node and the voltage on said fourth power supply node, a third insulated gate field effect transistor receiving said third voltage at a control electrode node and operating in a source follower mode for generating said first voltage, and a fourth insulated gate field effect transistor receiving said fourth voltage at a control electrode node, and operating in a source follower mode to generate said second voltage, wherein a difference between said third voltage and said fourth voltage is substantially equal to two times a difference between said first and second voltages, and said fifth voltage is substantially a half of a sum of said third and fourth voltages on said third and fourth control electrode nodes.

10. The voltage generation circuit according to claim 9, wherein said voltage generation means further comprises a fifth insulated gate field effect transistor receiving said fifth voltage at a control electrode node, and operating in a source follower mode for clamping an upper limit level of said first voltage, and a sixth insulated gate field effect transistor receiving said fourth voltage at a control electrode, and operating in a source follower mode for clamping a lower limit level of said second voltage.

11. The voltage generation circuit according to claim 9, wherein said voltage generation means comprises a first voltage generation section including a first resistance element and fifth and sixth diode-connected insulated gate field effect transistors, connected in series between said third power supply node and a first internal node for providing said third voltage from a connection of said first resistance element and said fifth insulated gate field effect transistor, and a second voltage generation section including a second resistance element and diode-connected seventh and eighth insulated gate field effect transistors, connected in series between said fourth internal node and said first power supply node for providing said fourth voltage from a connection of said second resistance element and said seventh insulated gate type field effect transistor.

12. The voltage generation circuit according to claim 11, wherein a sum of the voltage of said third power supply node and the voltage on said fourth power supply node is equal to a sum of said third and fourth voltages, and the voltage of said fourth power supply node is lower than said reference voltage by a sum of absolute values of threshold voltages of two of said fifth through eighth insulated gate field effect transistors.

13. The voltage generation circuit according to claim 9, wherein two of said fifth through eighth insulated gate field effect transistors have a same common conductivity type, and the other two of said fifth through eighth insulated gate field effect transistors each have a conductivity type opposited to said same common conductivity type.

14. The voltage generation circuit according to claim 9, wherein the voltage on said third power supply node is equal in level to a double of said first voltage.

15. The voltage generation circuit according to claim 9, wherein the voltage on said third power supply node has a voltage level lower than a sum of two times said first voltage and an absolute value of a threshold voltage of said fifth insulated gate field effect transistor by an absolute value of a threshold voltage of said seventh insulated gate field effect transistor, wherein the voltage of said fourth power supply node has a voltage level lower than said reference voltage by a sum of absolute values of respective threshold voltages of said fifth and seventh insulated gate field effect transistors, and said fifth and seventh insulated gate field effect transistors have conductivity types differing from each other.

16. The voltage generation circuit according to claim 11, wherein said voltage generation means further comprises a third voltage generation section connected between said third power supply node and a third internal node to which said fifth voltage is supplied, and including a third resistance element and ninth and tenth insulated gate field effect transistors each operating in a diode mode, connected in series to each other, and a fourth voltage generation section including a fourth resistance element and diode-connected eleventh and twelfth insulated gate field effect transistors, connected between said third internal node and said fourth power supply node in series with each other.

17. The voltage generation circuit according to claim 9, wherein said fifth voltage is provided from said first internal node.

18. The voltage generation circuit according to claim 1, wherein the voltage supplied from the output node of said voltage generation circuit used in a dynamic type semiconductor memory device, wherein said dynamic semiconductor memory device comprises a plurality of bit line pairs each having one column of memory cells connected thereto and receiving the voltage provided from said output node in a standby state.

19. The voltage generation circuit according to claim 1, wherein the voltage supplied from said output node is used in a dynamic type semiconductor memory device, wherein said dynamic type semiconductor memory device comprises a plurality of memory cells each including a capacitor for storing information in a form of electric charges, and an access transistor for reading out information stored in said capacitor, each said capacitor including a storage electrode node connected to a corresponding access transistor, and a common electrode receiving the voltage from said output node of said voltage generation circuit.

20. The voltage generation circuit according to claim 9, wherein said voltage generation means further comprises voltage divider means coupled between said third power supply node and said fourth power supply node for resistor-dividing the voltages on said third and fourth power supply nodes to generate said fifth voltage.

* * * * *